US011667352B2

(12) United States Patent
Leason et al.

(10) Patent No.: US 11,667,352 B2
(45) Date of Patent: Jun. 6, 2023

(54) FOILING WATERCRAFT

(71) Applicant: MHL Custom, Inc., Isabela, PR (US)

(72) Inventors: Nicholas Leason, Aguadilla, PR (US); Alan R. Taylor, Myakka City, FL (US); Matt Dessig, Sarasota, FL (US); Christopher Alexander Ruiz, Sarasota, FL (US)

(73) Assignee: MHL Custom, Inc.

( * ) Notice: Subject to any disclaimer, the term of this patent is extended or adjusted under 35 U.S.C. 154(b) by 46 days.

(21) Appl. No.: 16/850,480

(22) Filed: Apr. 16, 2020

(65) Prior Publication Data

US 2021/0323637 A1 Oct. 21, 2021

(51) Int. Cl.

| | |
|---|---|
| ***B63B 1/28*** | (2006.01) |
| ***B63B 34/10*** | (2020.01) |
| ***B63B 39/04*** | (2006.01) |
| ***B63B 39/06*** | (2006.01) |
| ***B63B 1/32*** | (2006.01) |

(52) U.S. Cl.

CPC ..... *B63B 1/285* (2013.01); *B63B 1/322* (2013.01); *B63B 34/10* (2020.02); *B63B 39/04* (2013.01); *B63B 39/06* (2013.01)

(58) Field of Classification Search

CPC ..... B63B 1/24; B63B 1/242; B63B 1/246; B63B 1/248; B63B 1/26; B63B 1/28; B63B 1/283; B63B 1/285; B63B 1/30; B63B 34/10; B63B 34/15; B63B 39/04; B63B 39/06; B63B 39/061; B63B 39/062; B63B 2039/063; B63B 2039/065;

(Continued)

(56) References Cited

U.S. PATENT DOCUMENTS 3,722,450 A * 3/1973 Arimura ..... B63B 1/28 114/280
3,804,048 A * 4/1974 Cline ..... B63B 1/283 114/281

(Continued)

FOREIGN PATENT DOCUMENTS

EP 3168126 B1 5/2018
FR 3089487 A1 * 6/2020 ..... B63B 1/283

(Continued)

OTHER PUBLICATIONS

International Search Report for PCT/US2021/026581 dated Jul. 27, 2021. 4 pgs.

*Primary Examiner* — Ajay Vasudeva
(74) *Attorney, Agent, or Firm* — Lerner David LLP

(57) ABSTRACT

A personal watercraft comprising a body having a seat and a hull, the seat configured to support a user with the body floating in water, a plurality of hydrofoils extending outwards from the body and coupled to a positioning system, the plurality of hydrofoils being configured, in combination, to raise the hull of the personal watercraft above a waterline in the water when the personal watercraft is in use and under the influence of a propulsion force, one or more sensors that provide sensor data of the watercraft during use, a computer-readable medium having a processor and a memory having instructions that, when executed by the processor read the sensor data, and based on the read sensor data, send a signal to the positioning system to adjust the position for at least one of the plurality of hydrofoils.

19 Claims, 14 Drawing Sheets

(58) Field of Classification Search
CPC ..... B63B 2039/066; B63B 2039/067; B63B 2039/068; B63B 1/32; B63B 1/322
See application file for complete search history.

(56) References Cited

U.S. PATENT DOCUMENTS

| | | | | |
|---|---|---|---|---|
| 3,886,884 | A | 6/1975 | Stark et al. | |
| 4,972,792 | A | 11/1990 | Yokoyama et al. | |
| 5,469,801 | A | 11/1995 | Payne | |
| 9,969,463 | B2 | 5/2018 | Pivec | |
| 10,099,754 | B2 | 10/2018 | Tian | |
| 10,532,793 | B2 | 1/2020 | Lagarrigue et al. | |
| 10,894,579 | B2 * | 1/2021 | Schnauffer ..... | B63H 20/06 |
| 2018/0201343 | A1 | 7/2018 | Lagarrigue et al. | |

FOREIGN PATENT DOCUMENTS

| | | | | |
|---|---|---|---|---|
| WO | 2018229351 | A1 | 12/2018 | |
| WO | WO-2021032277 | A1 * | 2/2021 ..... | B63B 1/26 |

* cited by examiner

FOILING WATERCRAFT

BACKGROUND

Personal watercrafts are normally operated by riding along the surface of a body of water. For example, the watercraft can glide on the water along its hull. Alternatively, a watercraft can include at least one hydrofoil such that the hull is lifted above the waterline during operation. To achieve such lift, the watercraft can ride through the water along its hull until enough speed is attained for a sufficient force to be applied to the hydrofoil(s) of the watercraft for the watercraft to be lifted above the waterline and supported by the hydrofoils.

While hydrofoils allow a watercraft to gain greater speed, and be more efficient in maintaining that speed, hydrofoils can also introduce greater issues with handling and maneuverability. For example, at certain speeds the hydrofoil watercraft may have greater difficulty making tight turns and maintaining a stable, upright position. Additionally, at certain speeds, the watercraft may be more susceptible to external forces, such as unexpectedly large waves. Therefore, further improvements are desirable.

Personal watercrafts, commonly referred to as a Jet Ski®, are small watercraft typically designed to allow only a few users at a time. Such a watercraft can be turned using a rudder/jet drive. Alternatively, due to the size of the watercraft relative to the user, the watercraft is typically designed to allow a user to lean into a turn, or otherwise react to the adjustment of the user's mass relative to the watercraft, similar to a motorcycle. Due to this functionality, personal watercraft can present unique challenges when used with hydrofoils, including challenges as to control, maneuverability and stabilization of the watercraft. As such, current hydrofoil technology is insufficient for use with these types of watercraft, and further improvements are needed.

BRIEF SUMMARY

In accordance with an aspect of the disclosure, a personal watercraft comprising a body having a seat and a hull, the seat configured to support a user with the body floating in water, a plurality of hydrofoils extending outwards from the body and coupled to a positioning system, the plurality of hydrofoils being configured, in combination, to raise the hull of the personal watercraft above a waterline in the water when the personal watercraft is in use and under the influence of a propulsion force, one or more sensors that provide sensor data of the watercraft during use, a computer-readable medium having a processor and a memory having instructions that, when executed by the processor read the sensor data, and based on the read sensor data, send a signal to the positioning system to adjust the position for at least one of the plurality of hydrofoils. Each of the hydrofoils may have a strut extending vertically outward away from the body of the personal watercraft and a transverse foil section extending transverse to the strut. The transverse section of each hydrofoil may extend transverse to the strut. The sensor data may include speed data, force data, position data, and proximity data. The sensor data may include a first positioning data and a second positioning data, wherein the instructions are based on the first positioning data for a first of the plurality of hydrofoils of the plurality of hydrofoils and a second positioning data for a second of the plurality of hydrofoils of the plurality of hydrofoils, the first positioning data being different than the second positioning data. A y-axis may extend vertically through the body, an x-axis extends horizontally through the body, and a z-axis extends lengthwise through the body, and the sensor data comprises data that positions each of the plurality of hydrofoils at a different position along at least one of the y-axis, the x-axis, and the z-axis. The sensor data may comprise data that positions each of the plurality of hydrofoils at a different position along each of the y-axis, the x-axis, and the z-axis. The instructions may include first and second instructions that correspond to first and second different riding modes for the personal watercraft, the first instructions, when executed, sends a first signal to the positioning system to adjust the position for each of the plurality of hydrofoils based on the first positioning data for each of the plurality of hydrofoils, and the second instructions, when executed, sends a second signal to the positioning system to adjust the position for each of the plurality of hydrofoils based on the second positioning data for each of the plurality of hydrofoils, the first and second positioning data for the first and second riding modes resulting in a different riding experience for the personal watercraft. A first of the plurality of hydrofoils may extend outwards from a rear of the body, the first hydrofoil including the propulsion system and being movable along a y-axis extending vertically through the body. At least some of the plurality of foils are removable from the body of the personal watercraft. The personal watercraft may further comprise a propulsion system for providing the propulsion force. The propulsion system may include a first sensor of the one or more sensors, the first sensor configured to provide a portion of the sensor data to the computer-readable medium. The personal watercraft may further comprising a modular battery pack system. Each hydrofoil of the plurality of hydrofoils may include an engagement mechanism configured to be engaged to the body.

In accordance with another aspect of the disclosure, a method of operating a personal watercraft comprising receiving a maneuver input to steer the personal watercraft in the water while in the foiling mode, sensing, by way of a sensor system while in the foiling mode, sensor data of the watercraft while in use, storing the sensor data in a computer-readable medium having a processor, a memory, and instructions, based on the sensor data, the processor executing the instructions to determine a stable position of each of the hydrofoils while in the foiling mode, and sending a first signal to a positioning system to move a first hydrofoil of the plurality of hydrofoils along one of the x, y, and z axes from a first position to a second, different position to place the first hydrofoil in the determined stable position. The watercraft may include a body and the plurality of hydrofoils extend from a front of the body, and the watercraft additionally comprises a rear hydrofoil extending from a rear of the body of the watercraft, the rear hydrofoil including the propulsion system. The method may further comprise moving the rear hydrofoil vertically along the y-axis. The rear hydrofoil may be rotatable and about the y-axis and vertically movable along the y-axis, but is fixed relative to the x and z axes. The method may further comprise sending a second signal to the positioning system to move a second of the plurality of hydrofoils along one of the x, y, and z axes from a first position to a second, different position. Moving the first hydrofoil may include moving the first hydrofoil along a plurality of the x, y, and z axes. Moving the first and second hydrofoils may include moving the first and second hydrofoils along a plurality of the x, y, and z axes independently of each other. The personal watercraft may have a plurality of riding modes and instructions, when executed, determines a different stable position for the plurality of hydrofoils based on the sensor data depending on which riding mode is selected. The maneuver input may have at a signal from at least one of a steering system or weight shift. The sensor data may include speed data, force data, position data, and proximity data.

In accordance with yet another aspect of the disclosure, a method comprising determining, by the one or more processors, an acceptable level of stability of a watercraft, detecting, by the one or more processors, a maneuver input, receiving, by the one or more processors, sensor data from a sensor housed within the watercraft, determining, by the one or more processors, a position of the watercraft based on the sensor data, comparing, by the one or more processors, the position of the watercraft with the acceptable level of stability to determine a category of stability of the watercraft, and sending, by the one or more processors, a signal to a positioning system to adjust a first hydrofoil based on the category of stability.

BRIEF DESCRIPTION OF THE DRAWINGS

These and other features, aspects, and advantages of the present invention will become better understood with regard to the following description, and accompanying drawings.

DETAILED DESCRIPTION

As used herein, when referring to the watercraft, directional terms are from the point of view of the center of the watercraft. The terms "left," "right," "up," or "down" means a left, right, up, or down direction from the center of the watercraft. "Clockwise" and "counterclockwise," means the rotation of the watercraft or a part of the watercraft about an X-, Y-, or Z-axis as viewed from the center of the watercraft. "Pitch" rate or angle means rotation about the X-axis, "yaw" rate or angle means rotation about the Y-axis, and "roll" rate or angle means rotation about the Z-axis. Illustrated throughout is an exemplary watercraft shown as a personal watercraft, commonly referred to as a jet ski. However, the present disclosure is not limited only to jet skis and can thus be used in combination with other types of watercraft.

Figure 1:
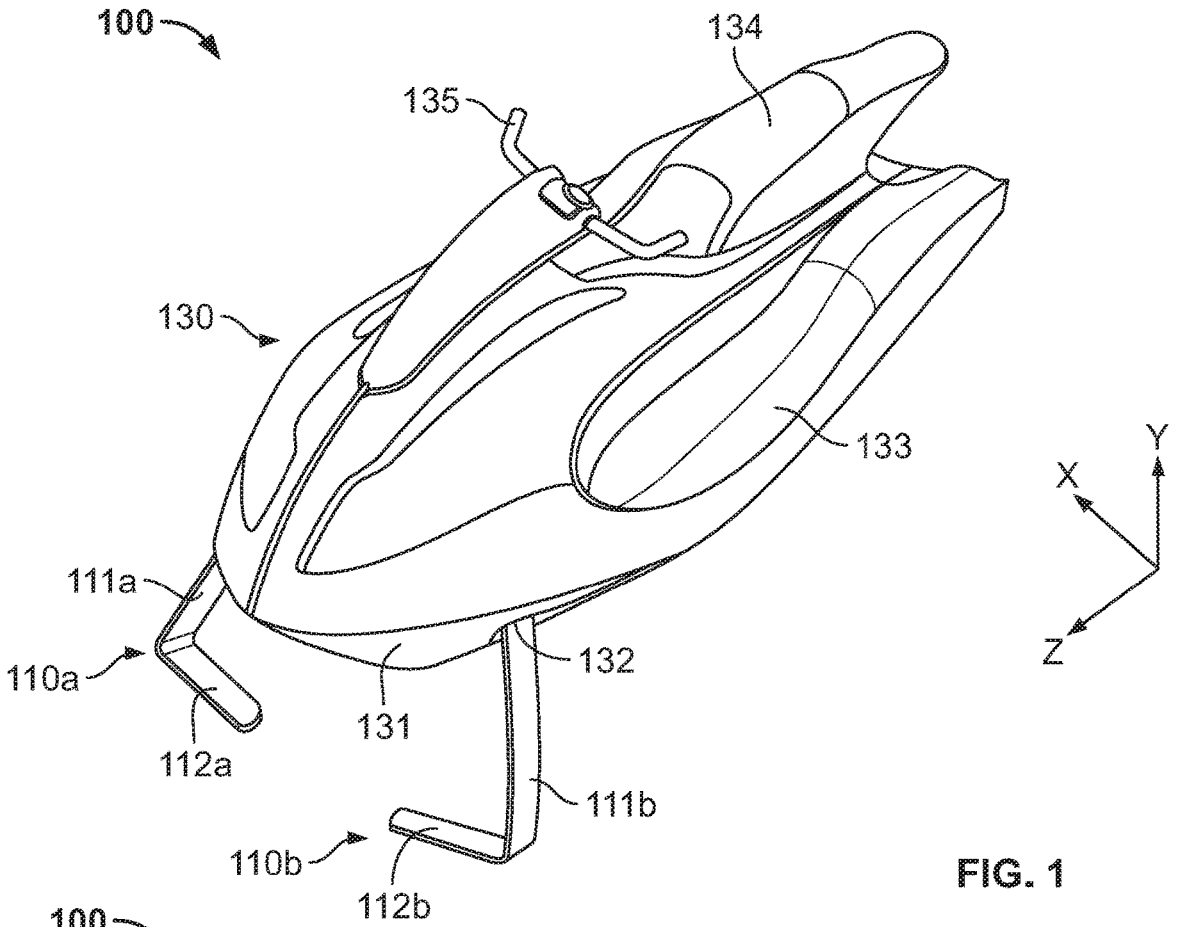
FIG. 1 depicts an isometric view of a watercraft according to one aspect of the disclosure.
Figure 2:
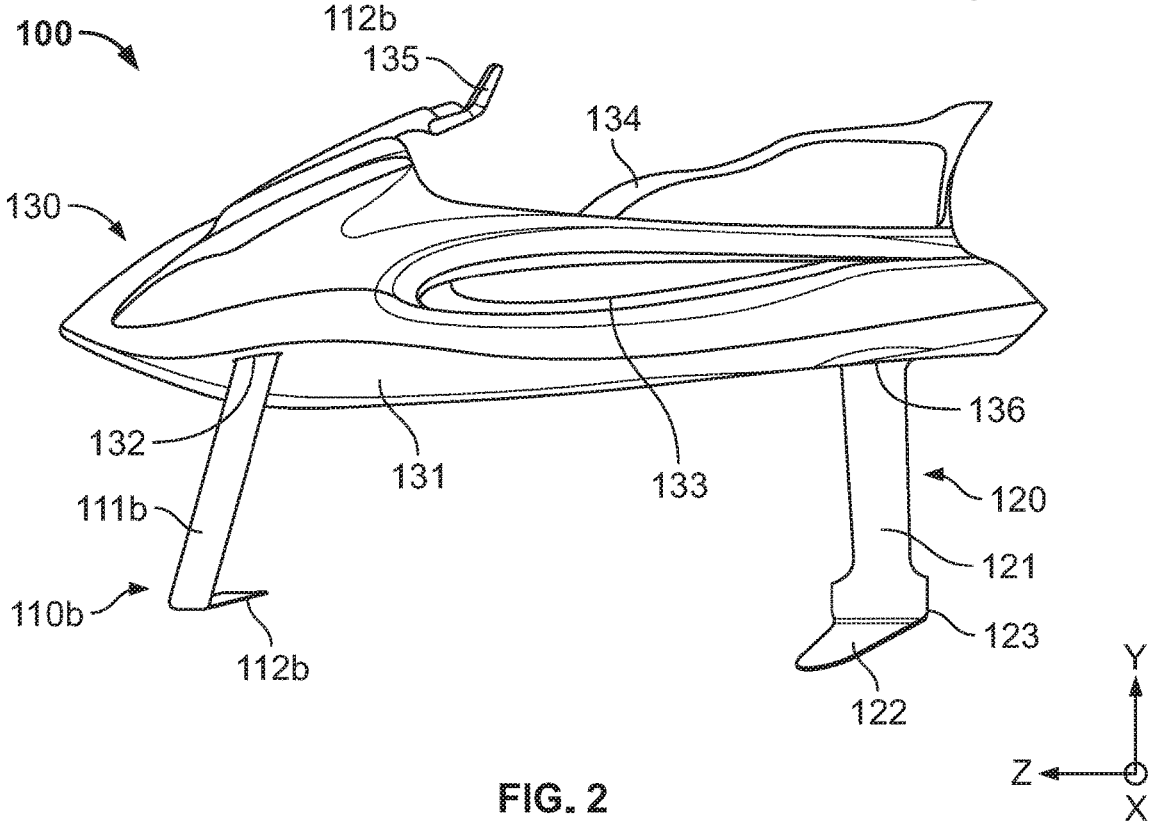
FIG. 2 depicts a side view of the watercraft of FIG. 1.
Figure 3:
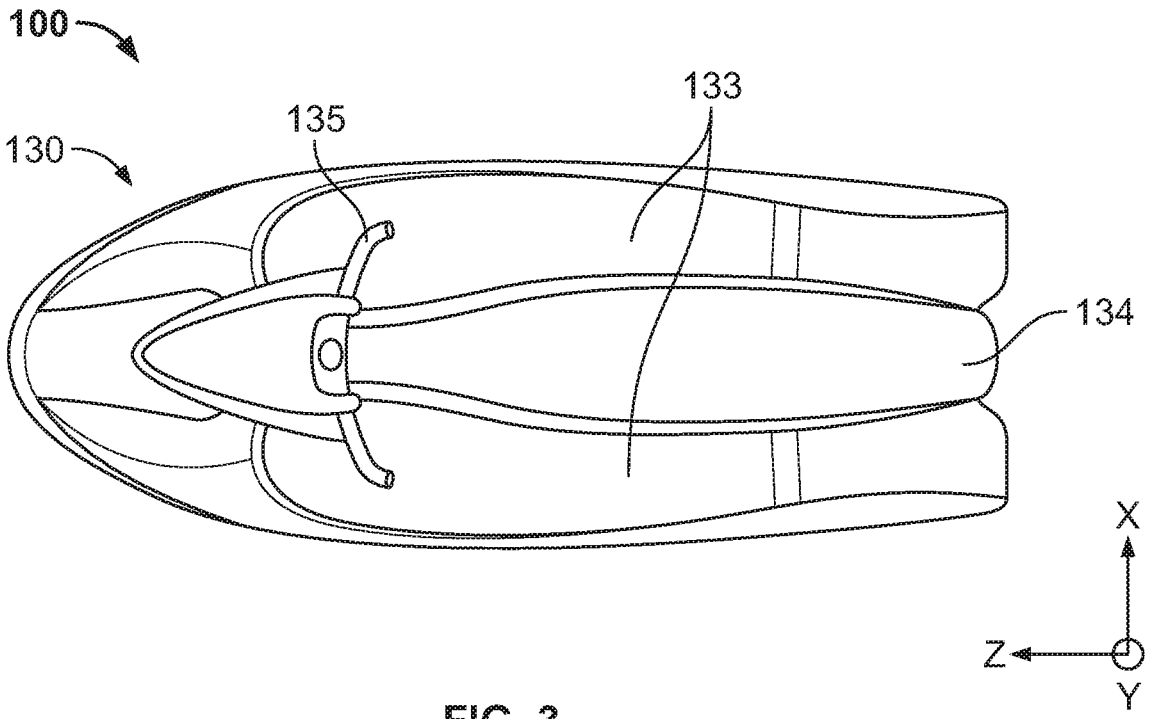
FIG. 3 depicts a top view of the watercraft of FIG. 1.
Figure 4:
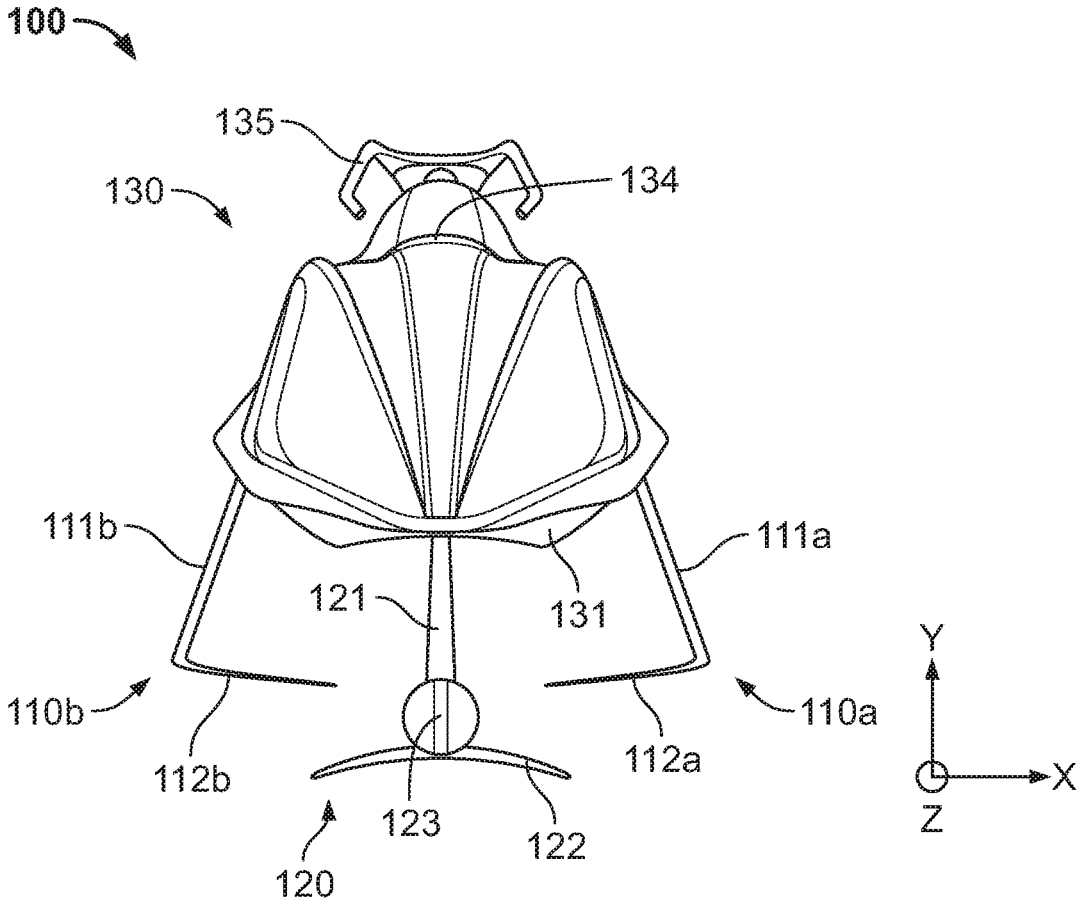
FIG. 4 depicts a back view of the watercraft of FIG. 1.

FIGS. 1-6 depict one embodiment of a watercraft 100 of the present disclosure. Watercraft 100 includes front hydrofoils 110*a,b*, rear hydrofoil 120, and a body 130. Body 130 is configured to float on water on at least one of hydrofoils 110*a,b*, 120 and/or hull 131. As shown in FIG. 1, the X-axis extends horizontally through watercraft 100 (i.e., extending in a starboard-port direction) and generally defines an X-direction, the Y-axis extends vertically through the watercraft (i.e., extending in an up-down direction) and generally defines a Y-direction, and the Z-axis extends lengthwise through the watercraft (i.e., extending in a fore-aft direction, or extending through bow and stern) and generally defines a Z-direction. Hydrofoils 110*a,b*, 120 and hull 131 include a shape and/or one or more material(s) to provide a sufficient buoyant force to watercraft 100 to allow the watercraft to float on the water during operation. Body 130 includes a seat 134 and one or more rests 133 (two rests illustrated in FIG. 3, for example) configured to support a user. For example, seat 134 and rest 133 can support a user sitting on seat 134 while rest 133 can support the user's feet. A steering system 135 is configured to be grasped by the user to provide control over the movement of watercraft 100. For example, as discussed further below, steering system 135 can turn watercraft 100 by turning hydrofoils 110*a,b*, 120 and/or turning hydrofoil 120, including its propulsion system 123.

Figure 16:
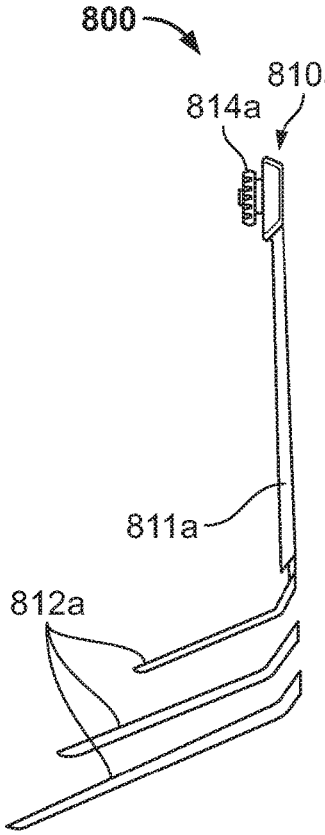
FIG. 16 depicts an isolated view of a hydrofoil of a watercraft according to still another aspect of the disclosure.
Figure 17:
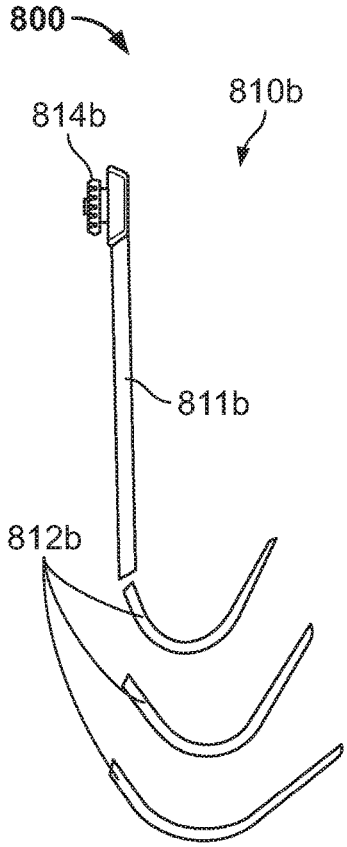
FIG. 17 depicts an isolated view of alternative shapes of the hydrofoil of the watercraft of FIG. 16.
Figure 18:
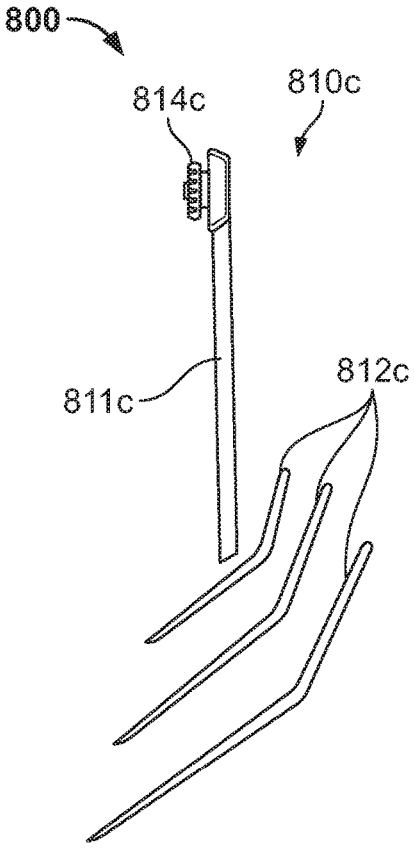
FIG. 18 depicts an isolated view of further alternative shapes of the hydrofoil of the watercraft of FIG. 16.

Continuing with this embodiment, front hydrofoils 110*a,b* extend from body 130 through openings 132 in body 130. Hydrofoils 110*a,b*, includes first strut 111 *a*, 111 *b* vertically extending from body 130 (e.g., substantially in the Y-direction) and first transverse foil sections 112*a,b* transversely extending from the first strut toward the midline or center of body 130 (e.g., substantially in the X-direction). Although hydrofoils 110*a,b* are depicted as being L-shaped, hydrofoils can have any shape, such as a T-shape, or other geometric shapes, examples of which are shown in FIGS. 16-18, below. In alternative aspects, transverse foil section 112*a,b* can extend transversely from the respective first strut 111*a,b* away from the midline or center of body 130. Still further, the transverse foil sections may instead be a continuous, monolithic length of strut extending along, between, and/or on either side of one or more vertical struts.

Figure 9:
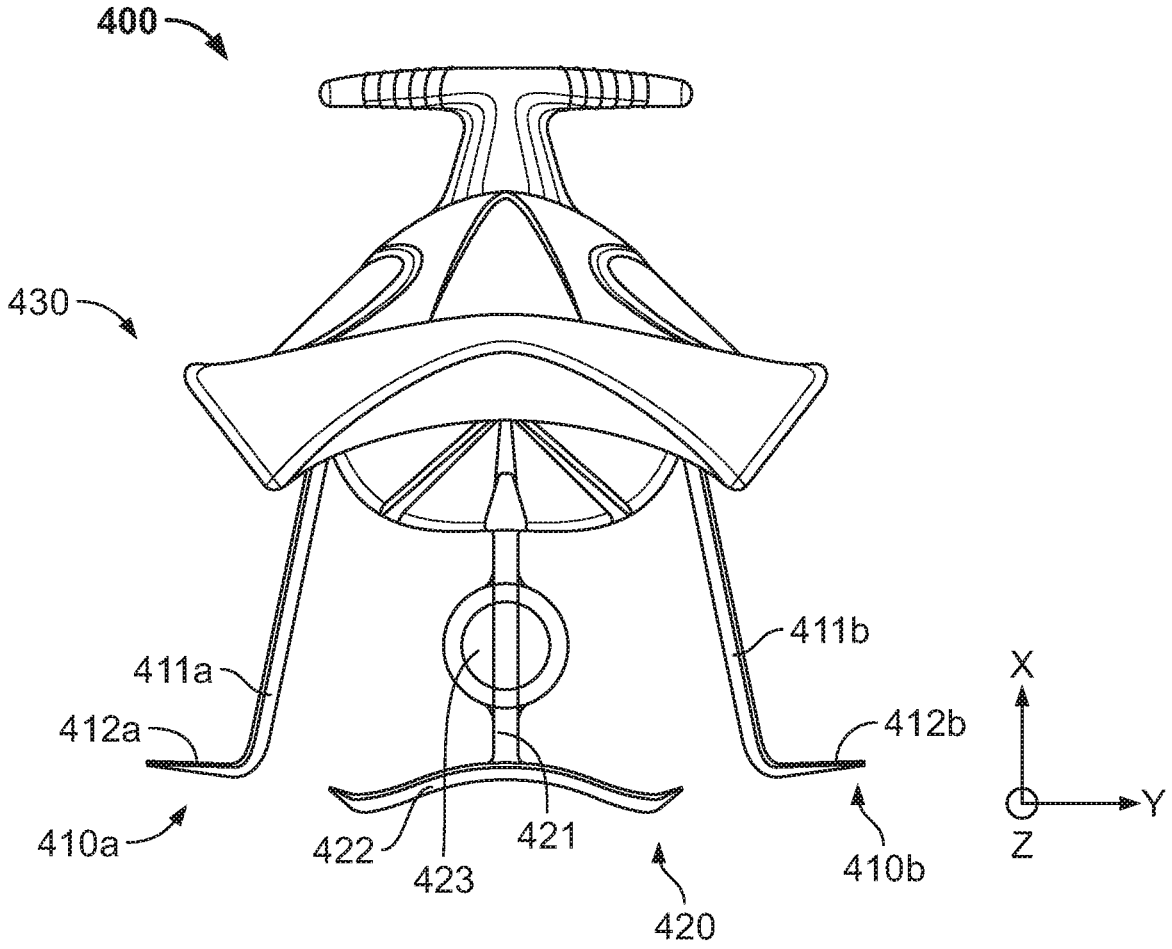
FIG. 9 depicts a back view of a watercraft according to still another aspect of the disclosure.

Further as to this embodiment, rear hydrofoil 120 extends from body 130 through opening 136 in body 130. Alternatively, rear hydrofoil 120 may simply extend from body 130, for example, from off of the underside of body 130 or from the transom of body 130. Hydrofoil 120 includes rear strut 121 vertically extending from body 130 (e.g., substantially in the Y-direction) and rear transverse foil sections 122 transversely extending from the rear strut (e.g., outwards away from the midline or center of body 130 and substantially in the X-direction). Hydrofoil 120 includes a propulsion system 123 at an end of rear strut 121, however, in alternative aspects, propulsion system 123 can be located along any portion of hydrofoil 120, one example of which is shown in FIG. 9, below, including along rear transverse foil sections 122. Propulsion system 123 can include a propeller, impeller, electric motor, a pump jet, or any other means of propelling watercraft 100. An engine (not shown) can be housed within hydrofoil 120 and/or body 130 to power propulsion system 123. Propulsion system 123 can be rotated synchronously with rear hydrofoil 120. Additionally or alternatively, propulsion system 123 can be rotated within rear hydrofoil 120 independent of the movement of the rear hydrofoil.

Figure 12:
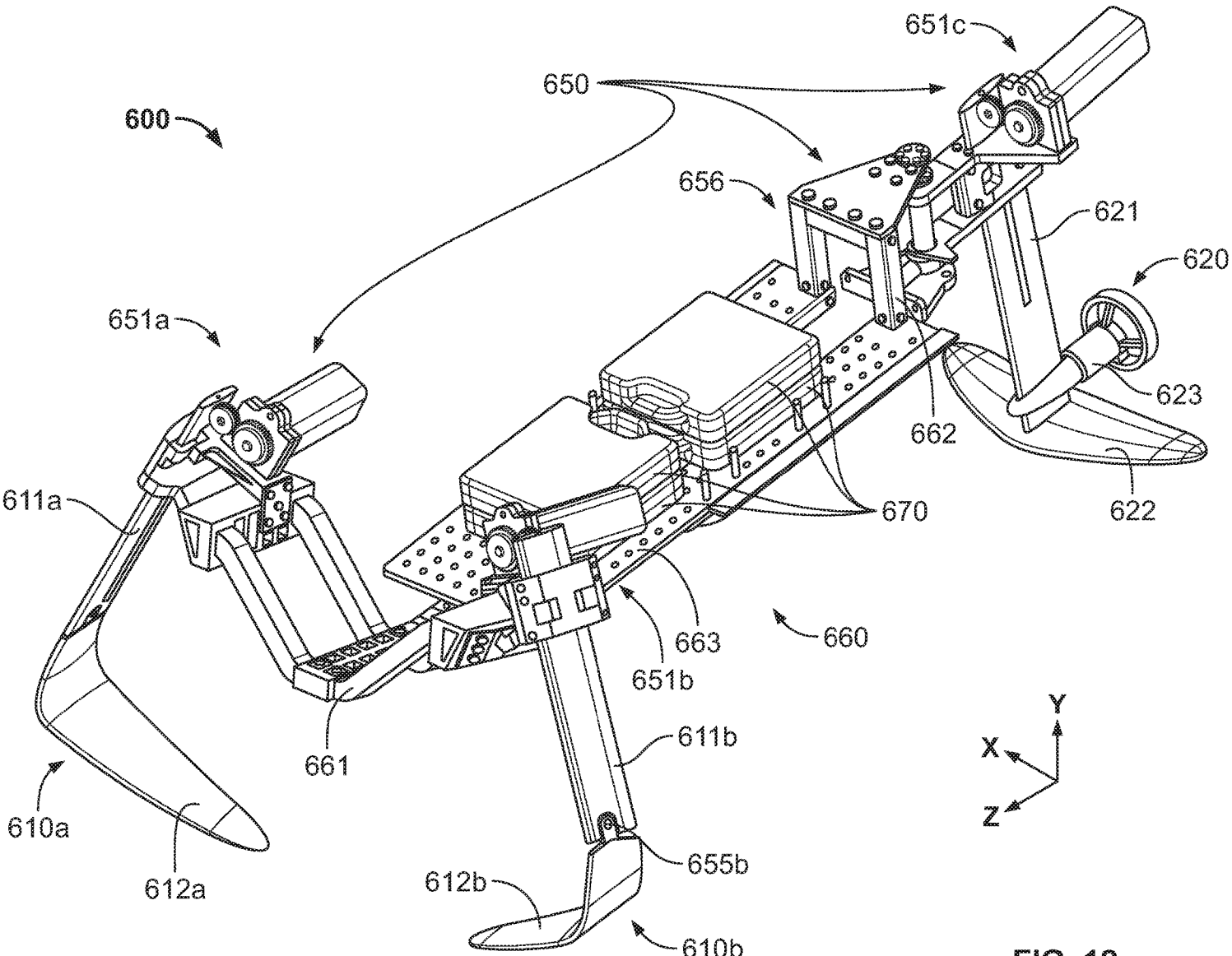
FIG. 12 depicts an isometric view of certain portions of a watercraft according to another aspect of the disclosure.
Figure 13:
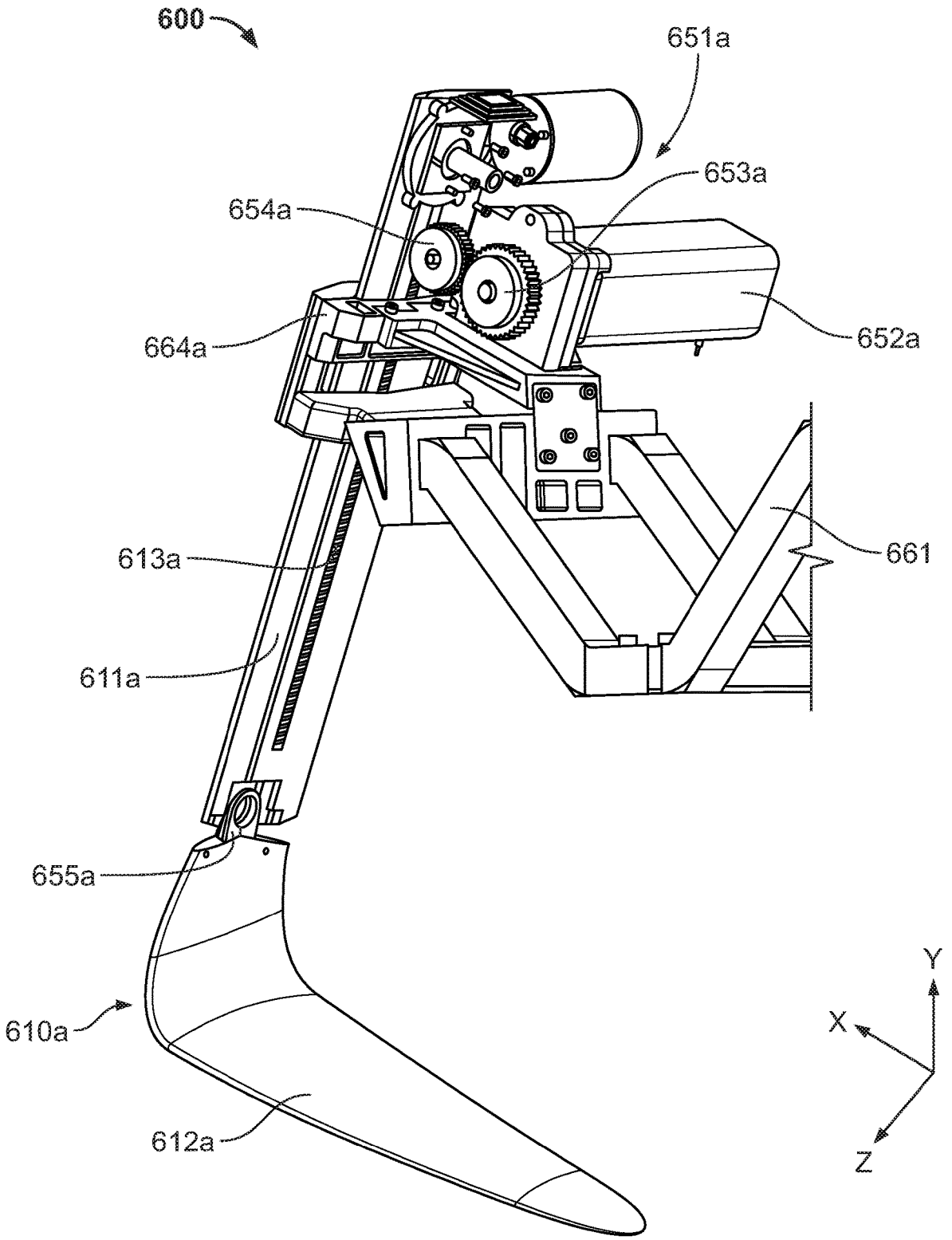
FIG. 13 depicts a partial view of the watercraft of FIG. 12.
Figure 14:
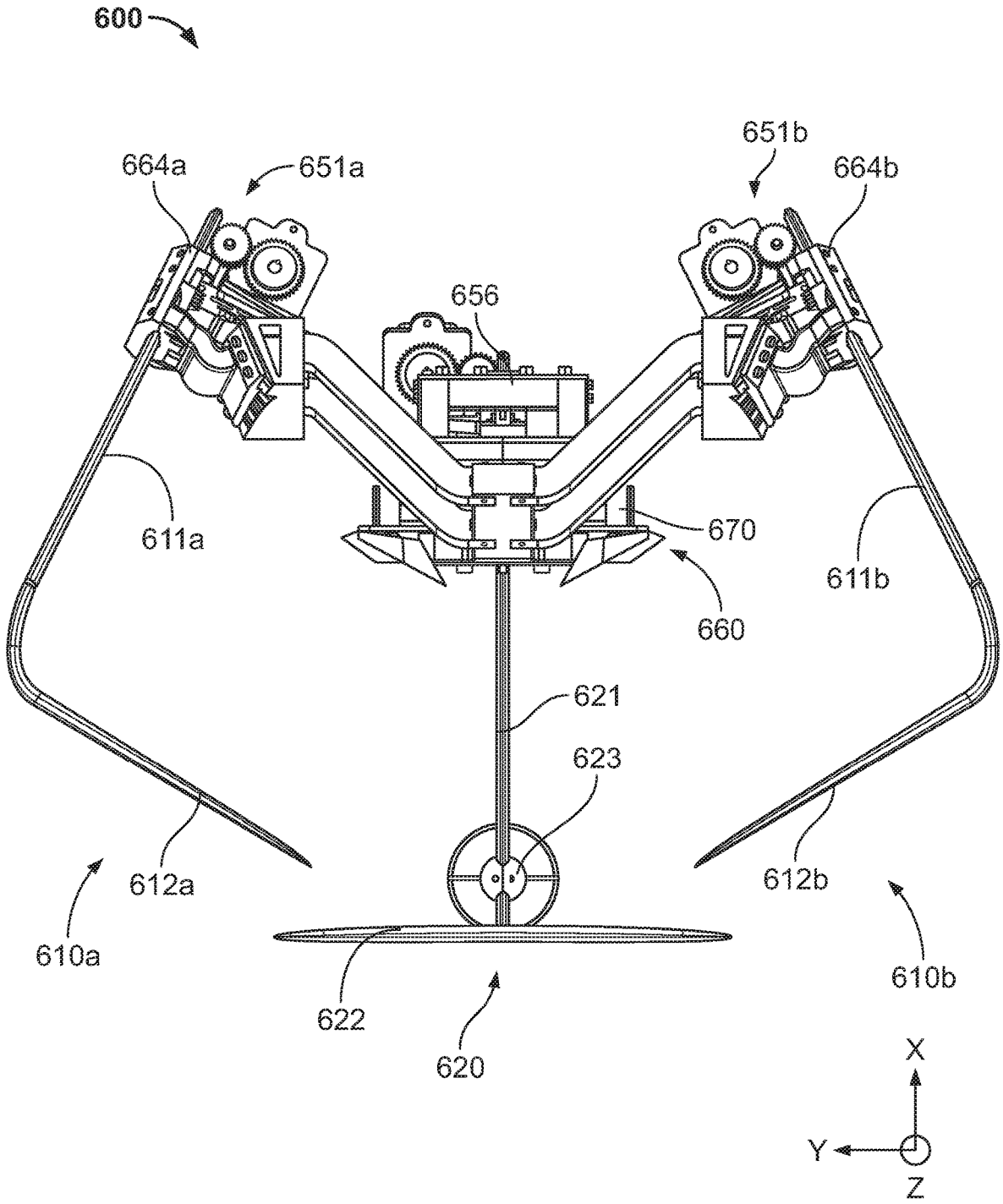
FIG. 14 depicts a front view of the watercraft of FIG. 12.

Hydrofoils 110*a,b*, 120 and/or propulsion system 123 can be independently rotated about any of the X-, Y- or Z-axes, and/or independently translated to be retracted within body 130 or extended further from body 130 through a positioning system (not shown), one example of which is shown in FIGS. 12-14, such as a servo, electric motor, or the like, coupled to any of the hydrofoils and/or propulsion system independently or in combination. For example, where each hydrofoil and the propulsion system are all controlled by an independent servo, electric motor, or the like, each of the hydrofoils 110*a,b*, 120 can be individually manipulated to provide precise movement of watercraft 100. For example, when watercraft 100 rolls clockwise (e.g., substantially about the Z-axis), hydrofoil 110*a* can retract within body 130 and/or hydrofoil 110*b* can extend further from the body.

Additionally or alternatively, hydrofoils 110*a,b*, 120 can be individually rotated in a clockwise direction (e.g., substantially around the Y-axis) when making a right turn. For example, rotation of hydrofoils 110*a,b*, 120 clockwise 10° relative to the Y-axis can yaw watercraft 100 clockwise about 10° about the Y-axis. Further, in another example, front hydrofoils 110*a,b* can be rotated 20° clockwise about the Y-axis while rear hydrofoil 120 can rotate a lesser degree, such as 10°, clockwise about the Y-axis to prevent the rotation of propulsion system 123 housed in the rear hydrofoil from overturning watercraft 100. In alternative aspects, any of hydrofoils 110*a,b*, 120 can be fixed with respect to one of the X-, Y- or Z-axis or multiple of the X-, Y-, or Z-axes. For example rear hydrofoil 120 may be fixed along the X- and Z-axes, and can only translate along the Y-axis. In a yet further alternative, rear hydrofoil 120 may turn about the Y-axis while hydrofoils 110*a,b* remain stationary to provide a change in yaw angle of watercraft 100.

Moreover, transverse foil sections 112*a,b*, 122 can be rotated relative to struts 111*a,b*, 121 about any of the X-, Y- or Z-axes through a hinging mechanism (not shown, though for example, see hinging mechanisms 655 *a,b* in FIG. 12) or the like. Hinging mechanism, if present, is a part of the positioning system. Transverse foil sections 112*a,b* can be coupled to struts 111*a,b*, 121 through the hinging mechanism. In this manner, the amount of lifting force can be adjusted for each of hydrofoils 110*a,b*, 120 to change at least one of the direction or rotation of watercraft 100. For instance, rotating at least a portion of transverse foil section 112*a* (such as its tip) upward substantially about the X-axis increases the angle of attack of hydrofoil 110*a* and rotating at least a portion of transverse foil section 112*b* (such as its tip) downward substantially about the X-axis decreases the angle of attack of hydrofoil 110*b*. As such, the lifting force applied to hydrofoil 110*b* is decreased while the lifting force applied to hydrofoil 110*a* is increased, thereby rolling watercraft 100 substantially about the Z-axis in a counter-clockwise direction. Opposite rotations of the transverse foil sections 112*a,b* can result in an opposite rolling motion of watercraft 100. In alternative aspects, there is no hinging mechanism, and struts 111*a,b*, 121 and transverse foil sections 112*a,b*, 122 are monolithically formed. In a further alternative, the entirety of hydrofoils 110*a,b* can be rotated about the X-axis to achieve a change in angle of attack and lifting forces.

Additionally or alternatively, rotation of hydrofoil 110*a,b* and/or 120 about the Y-axis will cause the craft 100 to make a turn with combined roll and yaw about the X and Y axes. For example, taking the above example of watercraft 100 rolling counter-clockwise about the Z-axis, as the watercraft rolls, transverse foil sections 112*a,b* become more vertical and in line with parallel with the Y-axis. As such, the change in angle can lead to a force applied to hydrofoils 110*a,b* to push watercraft 100 about the Y-axis and assist in making a turn. In this manner, a user providing weight shift may assist in turning watercraft 100 about the Y-axis in a similar manner to a motorcycle rider, in part, turning a motorcycle through leaning towards the turn.

When watercraft 100 is in a "foiling mode," hydrofoils 110*a,b*, 120 at least partially extend from watercraft 100 and are configured to support the weight of body 130 and any users operating the watercraft in that hull 131 is substantially or completely out of the water. This mode can be achieved when watercraft 100 achieves a certain speed and sufficient lifting forces are applied to hydrofoils 110*a,b*, 120 to lift hull 131 substantially or completely above the waterline. While watercraft 100 is in foiling mode, watercraft 100 can achieve a stable position where, for example, the weight of body 130 is supported by at least one of hydrofoils 110*a, b*, 120 and the hull 131 is substantially or completely out of the water. Also, while in foiling mode, the watercraft 100 has a "level of stability" which is established by determining the susceptibility of watercraft 100 to tipping over and losing its stable position. For example, if watercraft 100 is in foiling mode in an upright position and going straight, the watercraft is in a stable position and has a high acceptable level of stability. Alternatively, when watercraft 100 is in a foiling mode and is tipping in a certain direction, such as when making a turn, the watercraft may still be in a stable position but would also have a lower acceptable level of stability due to the increased risk of tipping over if, for example, there is an unexpectedly large wave, the user makes a sudden or exaggerated movement, or the like.

When watercraft 100 is in a "hulling mode," body 130 is supported on the water by hull 131. When watercraft 100 is in hulling mode, hydrofoils 110*a,b*, 120 can be retracted, or can extend away from body 130 when watercraft 100 is going at a slow enough speed that the weight of body 130 is not substantially or completely borne by the hydrofoils. For example, when watercraft 100 is stationery in the water or in idle, the watercraft is in hulling mode due to floating on hull 131. While watercraft 100 is in the hulling mode, it may be in a stable position where the weight of body 130 is supported by hull 131 and the body 130 and user are in a balanced position. Watercraft 100 can also have a level of stability where the susceptibility of watercraft 100 to tipping over and losing its stable position.

The levels of stability may be maintained, at least in part, by a hydraulic system coupled to the hydrofoils, for example. The hydraulic system is configured to absorb the impact of forces being applied to the hydrofoils. For example, when the watercraft hits a wave during operation in foiling mode, the hydraulics can absorb the impact of hitting the wave by allowing a 15 cm range of motion of the hydrofoils. In this manner, the impact force of the wave is not transferred to the body of the watercraft and allows for a smoother ride for the operator. Alternatively, the hydraulics may allow for the hydrofoils to maintain their position and for the body of the watercraft to move relative to the hydrofoils to absorb the impact of hitting the wave.

Figure 5:
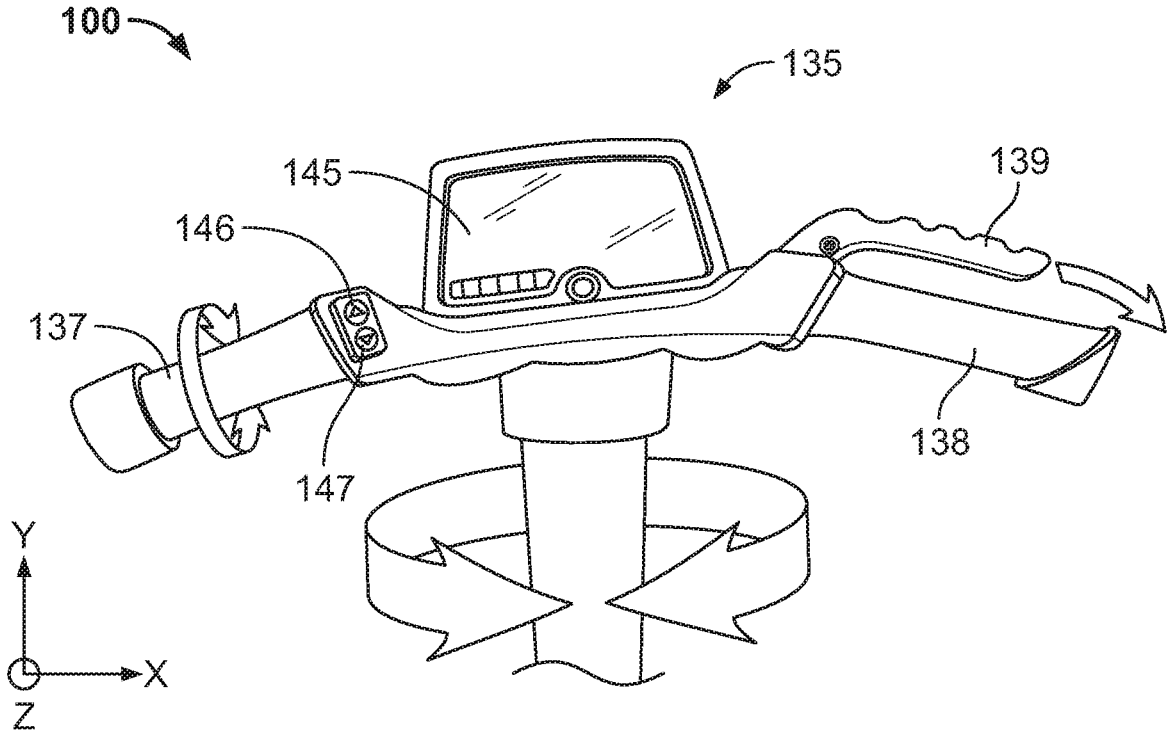
FIG. 5 depicts a partial view of an example of a steering system to be included in a watercraft of the present disclosure, such as the watercraft of FIG. 1.

FIG. 5 depicts one embodiment of a steering system 135 which can be used with watercraft 100, including a left throttle 137, right throttle 138, and screen 145. Screen 145 (if present) is configured to display information regarding watercraft 100, such as the speed, tilt angle of hydrofoils 120*a,b*, 120, foiling or hulling mode of the watercraft, current level of pitch control, current category of stability (discussed further below), or any other information related to operation and status of the watercraft. Further, screen 145 displays the various user profiles and adjustable stability settings. Rotation of steering system 135 about the Y-axis can turn watercraft 100 to the right or left through manipulation of hydrofoils 110*a,b*, 120, and/or propulsion system 123.

Throttle 139 adjacent handle 138 controls the power to the propulsion system 123, and thus, can control the speed of watercraft 100. For instance, squeezing throttle 139 can increase power to propulsion system 123 of watercraft 100 while release of the throttle decreases or eliminates power to the propulsion system.

Rotation of left throttle 137 controls the pitch of watercraft 100, or rotation of the watercraft about the X-axis. This can be performed by one or a combination of adjusting transverse hydrofoil sections 112*a,b*, 122 relative to struts 111*a,b*, 121, and/or raising or lowering hydrofoils 110*a,b*, 120. In this manner, the amount of force being applied between the front and rear ends of watercraft 100 can be adjusted to pitch the nose of the watercraft down or up.

Buttons 146, 147 are configured to determine the amount of pitch change for each rotation of left throttle 137. For example, pressing button 146 can increase the pitch angle for each rotation of left throttle 137 to 5° such that each forward/backward rotation of the left throttle will pitch watercraft 100 forward/backward 5°. Pressing button 147 can decrease the pitch angle from the 5° pitch angle previously set to 2° such that each forward/backward rotation of left throttle 137 will pitch watercraft 100 forward/backward 2°. Alternatively, buttons 146, 147 can act to adjust hydrofoils 110*a,b*, 120 to change the pitch angle of watercraft 100 by themselves, and without requiring left throttle 137 to be actuated. For example, pressing button 146 can pitch watercraft 100 forward while pressing button 147 can pitch watercraft 100 backward. These buttons may also provide the user with a simple way to return the foils to a neutral state, for example, where the pitch remains at a stable position based on the speed and center of gravity of the watercraft 100.

Figure 6:
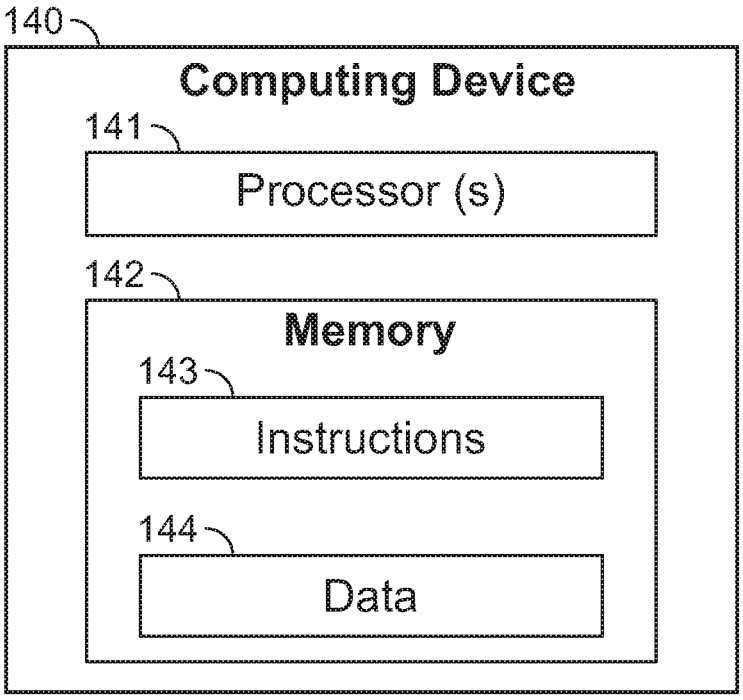
FIG. 6 depicts a schematic view of an exemplary positioning system to be included in a watercraft of the present disclosure, such as the watercraft of FIG. 1.

Body 130 may house a computing device 140, one embodiment of which is shown in FIG. 6 having one or more processors 141 and memory 142. Computing device 140 can be incorporated in, for example, a computer-readable medium, that takes in data collected from sensors (not shown) housed within body 130 and/or hydrofoils 110*a,b*, 120, and sends a signal to a positioning system (not shown) to adjust the position of the front and/or rear hydrofoils, and/or propulsion system 123, to maintain an acceptable level of stability while operating watercraft 100.

The one or more processors 141 can be a general central processing unit ("CPU"), or a dedicated component, such as an application specific integrated circuit ("ASIC") or field-programmable gate array ("FPGA"), or other hardware-based processor.

Memory 141 can communicate with the one or more processors 141, and includes instructions 143 and data 144. Memory 141 can be a hard-drive, memory card, a tape drive, ROM, RAM, DVD, CD-ROM, or write-capable memory.

Instructions 143 can be directly executed by the one or more processors 141, such as through machine code, or indirectly executed, such as through scripts or independent source code modules that are interpreted on demand or compiled in advance. As described further below, instructions 143 may include instructions executed by the one or more processors 141 to send a signal to the positioning system to adjust a portion of watercraft 100, such as hydrofoils 110*a,b*, 120 and propulsion system 123. There may be a different set of instructions depending on the level of stability that is detected by computing device 140. For example, as discussed further below, there may be a first set of instructions when computing device 140 detects that watercraft 100 is in a "Sport" mode, allowing for a lower level of stability, and a second set of instructions when the computing device detects that the watercraft is in a "Comfort" mode, providing for a higher level of stability.

Data 144 can be acquired by one or more sensors (not shown) and can be any data capable of being retrieved, stored, and modified by the one or more processors 141 according to instructions 143. Such data includes force data from the forces applied to hydrofoils 110*a,b*, 120, such as from the positioning of the foils, the position of the center of gravity based on weight of body 130 (including the weight distribution of the user and internal components of the body) and external environmental forces (e.g., from the waves, air resistance, gravitational forces, centrifugal forces), as well as other data such as position data of the hydrofoils and the body in X-, Y- and Z-coordinates (e.g., the tilt angle), proximity data of the distance between body 130 and the water line, and speed data of watercraft 100 (including the acceleration of the watercraft). Such sensors can be any one or more of an accelerometer, gyroscope, force sensor, sonar, optical, proximity, or any other sensor capable of providing position data, proximity data, speed data, or the like, of watercraft 100 to computing device 140. For example, the sensors may provide the individual position of hydrofoils 110*a,b*, 120 in X-, Y-, and Z-axes coordinates relative to body 130. Further, the sensors may provide data of the forces being applied to hydrofoils 110*a,b*, 120 and/or body 130. Even further, the sensors may provide data of the tilt of body 130 and the proximity of the body to the waterline. Data 144 can have any data structure and can be stored within a computer register, as a table having many different fields and records, or as XML documents. Data 144 can also be formatted in a computing device-readable format, such as ASCII, Unicode, or as binary values. Additionally, data 144 can have additional characteristics capable of identifying the relevant data, such as numbers, pointers, descriptive text, codes, or information that is used by a function to calculate the relevant data.

Computing device 140 can work in conjunction with, or independent of, steering system 135 to automatically move the position of hydrofoils 110*a,b*, 120 and/or propulsion system 123 relative to the body depending on which mode watercraft 100 is in. Additionally or alternatively, the sensors may detect a weight shift by the user or tilt of watercraft 100, and positioning system 140 can adjust hydrofoils 110*a,b*, 120 and/or propulsion system 123 to turn in accordance with the weight shift of the user.

For example, when watercraft 100 is in a foiling mode and a user turns steering system 135, or leans on body 130, toward the left to make a left turn, computing device 140 can automatically send a signal to the positioning system to adjust the hydrofoils by retracting hydrofoil 110*b* within body 130 and/or extending hydrofoil 110*a* further from the body to tilt watercraft 100 towards the left in a counter-clockwise direction about the Z-axis. Alternatively or additionally, at least a portion of transverse foil section 112*a* can be downwardly rotated to decrease the angle of attack while at least a portion of transverse foil section 112*b* can be upwardly rotated to increase the angle of attack to roll watercraft 100 substantially clockwise about the Z-axis. As watercraft 100 rolls, the transverse foil sections 112*a,b* become more vertical, thus changing the forces applied on hydrofoils 110*a,b* so as to turn the watercraft about the Y-axis. While making the turn, sensors can provide sensor data to computing device 140 about the stability of watercraft 100.

Using this data, the computing device and sensors can automatically detect and send a signal to the positioning system to adjust the positions of hydrofoils 110*a,b*, 120 in real-time so that watercraft 100 can either maintain a stable position depending on what kind of maneuvering the watercraft is performing at any given moment or to adjust watercraft 100 from an unstable positon to a stable position. In one instance, the positions of hydrofoils 110*a,b*, 120 can be adjusted based on the force data applied to hydrofoils 110*a,b*, 120 from the gravity of body 130 and any user(s) at a given speed. In this manner, watercraft 100 is not tipping over excessively to cause the user(s) to be thrown from the watercraft or to become unbalanced during a maneuver. For example, the sensors can detect that watercraft 100 is going at 50 miles per hour and computing device 140 can determine that the watercraft can only have a maximum roll angle of 5° to maintain the desired level of stability. This is in contrast with the sensors detecting watercraft 100 going at a lower speed, such as 20 miles per hour, where computing device 140 can determine that the maximum roll angle can be higher, such as 10°, to maintain the desired level of stability. In this manner, computing device 140 can take into account the centrifugal force applied to watercraft 100.

Computing device 140 can additionally use the data collected by the sensors to predict the level of stability of watercraft 100. For example, when making a left turn in a foiling mode, computing device 140 can determine that watercraft 100 is currently in an stable position without fear of watercraft 100 tipping over, however the computing device can determine that a change in speed and/or external forces being applied to a portion of the watercraft may run the risk of tipping the watercraft over. Depending on the acceptable level of stability, the computing device may send signals to the positioning system to make further adjustments to hydrofoils 110*a,b*, 120 and/or propulsion system 123 to account for this potential risk.

The level of stability of watercraft 100 can be changed based on user selection and/or manufacturer default. For example, a user can select a first "Comfort" mode, where computing device 140 requires watercraft 100 to have a higher level of stability. This higher level of stability increases the level of control computing device 100 has on maneuvering watercraft 100. For instance, when a user is making a turn while watercraft 100 is in a foiling mode and Comfort mode, computing device 140 may prefer watercraft 100 to stay more upright and only send signals to adjust hydrofoils 110*a,b*, 120 and/or propulsion system 123 to allow, for example, watercraft 100 to deviate about the Z-axis and away from the Y-axis, a maximum of 10°.

Alternatively, a user can select a second "Sport" mode, where computing device 140 allows watercraft 100 to have a lower level of stability. This lower level of stability decreases the level of control computing device 100 has on maneuvering watercraft 100. For instance, when a user is making a turn while watercraft 100 is in a foiling mode and Sporty mode, computing device 140 may send signals to adjust hydrofoils 110*a,b*, 120 and/or propulsion system 123 to allow watercraft 100 to have a greater degree of tilt about the Z-axis and away from the Y-axis, such as 25°.

Further, watercraft 100 can have custom modes tailored for each user. For example, a first user may designate watercraft 100 to have a first mode with a first customized level of stability labeled under the first user's name while a second user may designate the watercraft to have a second mode with a second customized level of stability under the second user's name. Each of the two modes can be specific to the user through customizing the settings that go into determining the acceptable level of stability. For example, the user may set a maximum acceptable level of pitch, roll, and yaw angle of tilt about the X-, Y-, and Z-axes of watercraft 100 at certain speeds, a maximum speed and/or acceleration, absorption values of the hydraulic system, or the like.

Alternatively or additionally, where a user is unsure as to what mode is most comfortable for them and is not familiar with the various settings in customizing their acceptable level of stability, computing device 140 can assist in customizing a mode specific to the user. For example, computing device 140 can first instruct the user to input their weight. Alternatively, the sensors of computing device 140 can automatically detect the weight of the user. Then, computing device 140 can instruct the user to go through a series of test operations through instructions shown as a visual prompt on a screen, or an audio prompt through speakers, housed in body 130. These test operations can include, for example, requesting the user go to a maximum speed they are comfortable with, making a series of turns at various speeds through both weight-shifting and turning steering system 135, or other operations that can provide data regarding an acceptable level of stability the user may find comfortable. While the user is performing these test operations, computing device 140 can track and store data related to those operation to assist in determining a custom mode for the user. For example, after the user undergoes the test operations, computing device 140 stores data that this user has a low maximum speed, relative to the maximum speed achievable by watercraft 100, at which the user is comfortable with and uses minimal weight-shifting when making turns. In such an instance, position system 140 may customize a mode for the user that has a greater acceptable level of stability, more akin to Cruising mode. Alternatively, where computing device 140 stores data that a user has a high maximum speed and uses a lot of weight-shifting when making turns, the computing device may customize a mode for the user that has a lower acceptable level of stability, more akin to Sporty mode.

In a further alternative, such custom modes can additionally be determined by an artificial intelligence system stored within computing device 140, such as through machine learning instructions stored in instructions 143. For example, a user may enable a setting that allows watercraft 100 to continually track data of the operation of watercraft 100 and for position system 140 to use that data to make changes to the acceptable level of stability. For example, a custom mode for a user that is new to operating watercraft 100 may initially have a maximum degree of tilt about the Z-axis of 15°. However, as the user becomes more proficient at operating watercraft 100, the user may try to tilt past 15° about the Z-axis. Where computing device 140 detects that the user is consistently hitting the maximum degree of tilt while operating watercraft 100, the computing device may update the custom mode for that user to increase the maximum degree of tilt to, for example 16°. In this manner, the user is not required to manually update the settings of their custom mode. Further, this machine learning method of determining the acceptable level of stability may allow a user to learn to operate watercraft 100 at their own pace and without fear of having a level of stability that the user is not comfortable with (e.g., where the user under- or overestimates their ability to operate watercraft 100 and customizes their perceived acceptable level of stability accordingly).

No matter how the levels of stability are customized or selected for the user, computing device 140 can have a certain maximum constraint threshold that prevents the user from attempting to customize watercraft 100 to be able to tip over and lose its stable position. For instance, computing device 140 can calculate and set a maximum roll angle from an upright position, such as 25°, no matter how the level of stability is customized for the user. In this manner, the user cannot inadvertently set a level of stability as to allow watercraft 100 to lose its stable position.

In further alternative aspects, a user can have any number of choices to determine the level of stability. For example, a user can select from a spectrum of acceptable levels of stability, such as in the form of a dial, ranging from a certain maximum level of stability (e.g., a stability level of 10) where computing device 140 adjusts watercraft 100 to remain predominantly upright to a certain minimum level of stability (e.g., a stability level of 0) having the computing device allow for maximum maneuvering control of the watercraft by the user. In this manner, a user may easily and quickly select between different modes and acceptable levels of stability while operating watercraft 100. In a yet further alternative aspect, the latter option may be considered a "Manual" mode and may be preferred in the instance of an emergency, such as a potential collision. In such an instance, the user can quickly enable Manual mode to take full control of watercraft 100 and avoid the collision.

Figure 7:
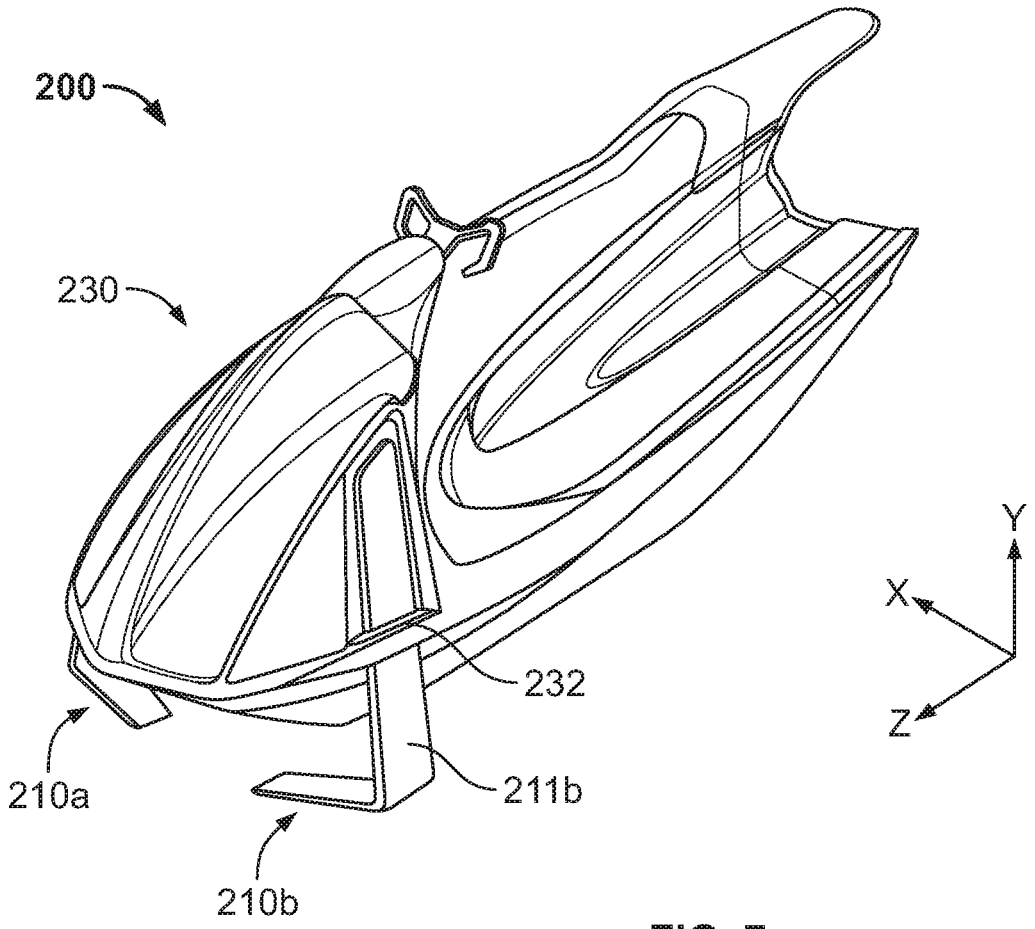
FIG. 7 depicts an isometric view of a watercraft according to another aspect of the disclosure.

FIG. 7 depicts watercraft 200 that can include features of watercraft 100. In this embodiment, hydrofoils 210*a,b* are partially retracted within body 230 through opening 232.

Figure 8:
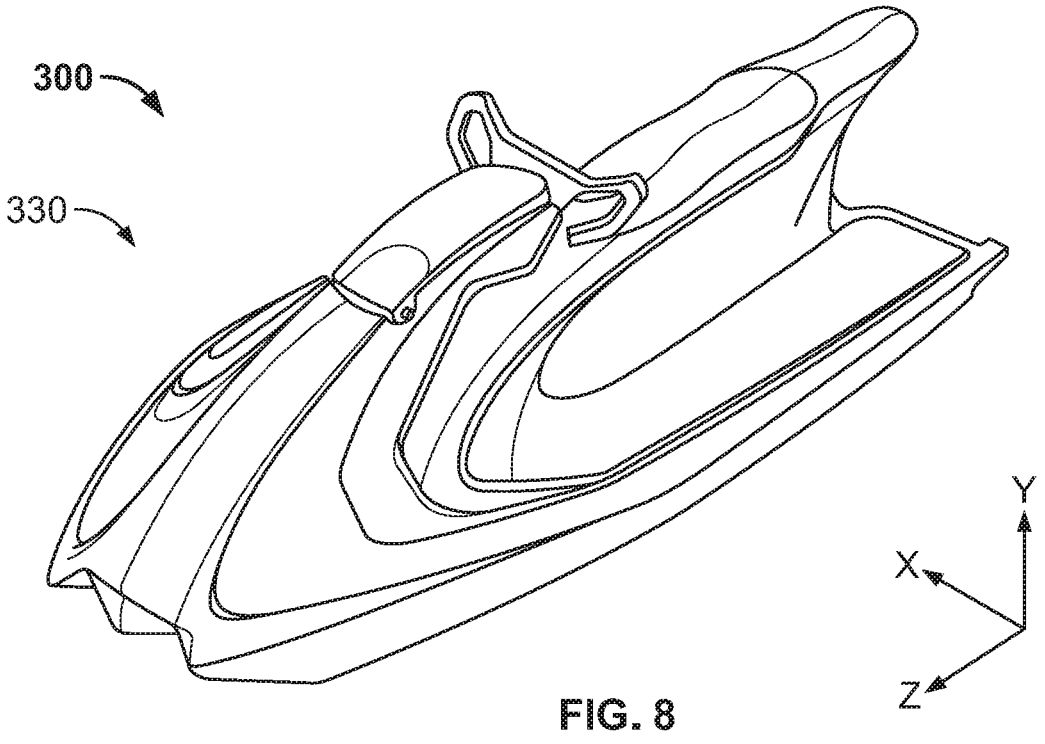
FIG. 8 depicts an isometric view of a watercraft according to yet another aspect of the disclosure.

FIG. 8 depicts watercraft 300 that can include features of watercraft 100. In this embodiment, the hydrofoils (not shown) are completely retracted within body 330. Additionally, the bow of watercraft 300 is shaped to have a central recess defined between two adjacent tips.

FIG. 9 depicts watercraft 400 that can include features of watercraft 100. In this embodiment, front hydrofoils 410 *a*, 410 *b* include transverse foil sections 412 *a*, 412 *b* extending away from the midline of body 430. Rear hydrofoil 420 includes a propulsion system along an intermediate portion of rear strut 421. Rear hydrofoil 420 additionally includes a non-planar rear transverse section 422.

Figure 10:
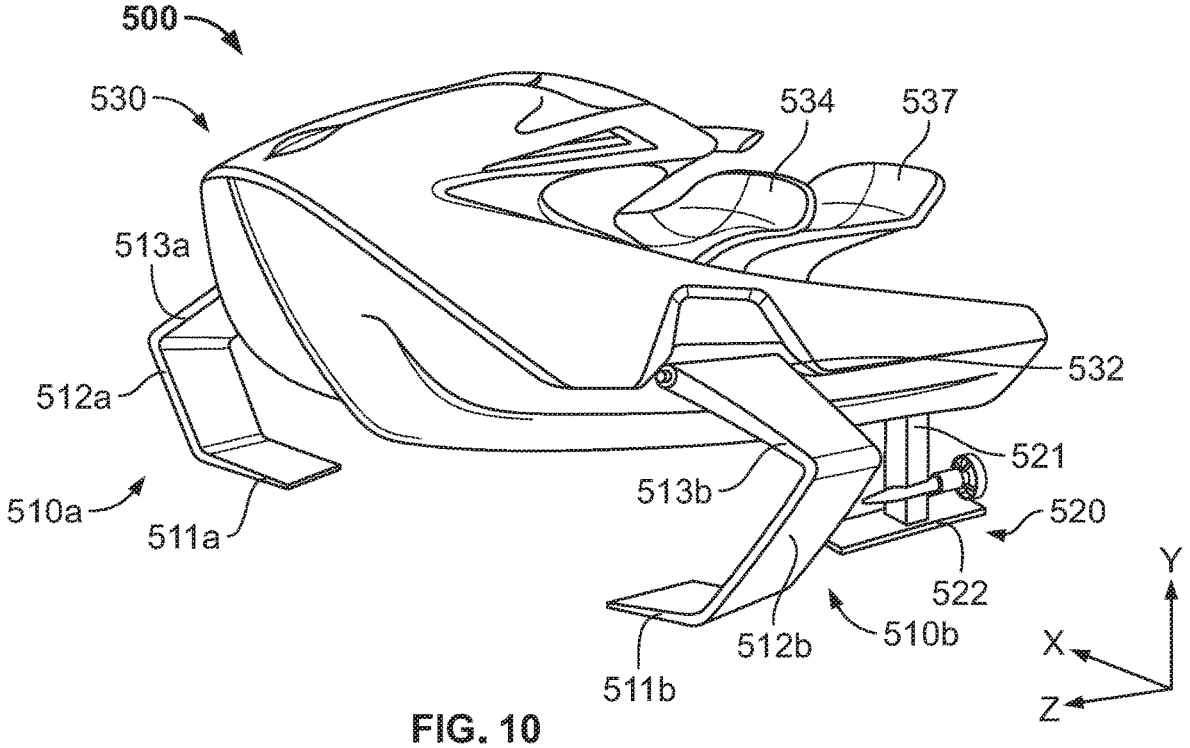
FIG. 10 depicts an isometric view of a watercraft according to a further aspect of the disclosure.
Figure 11:
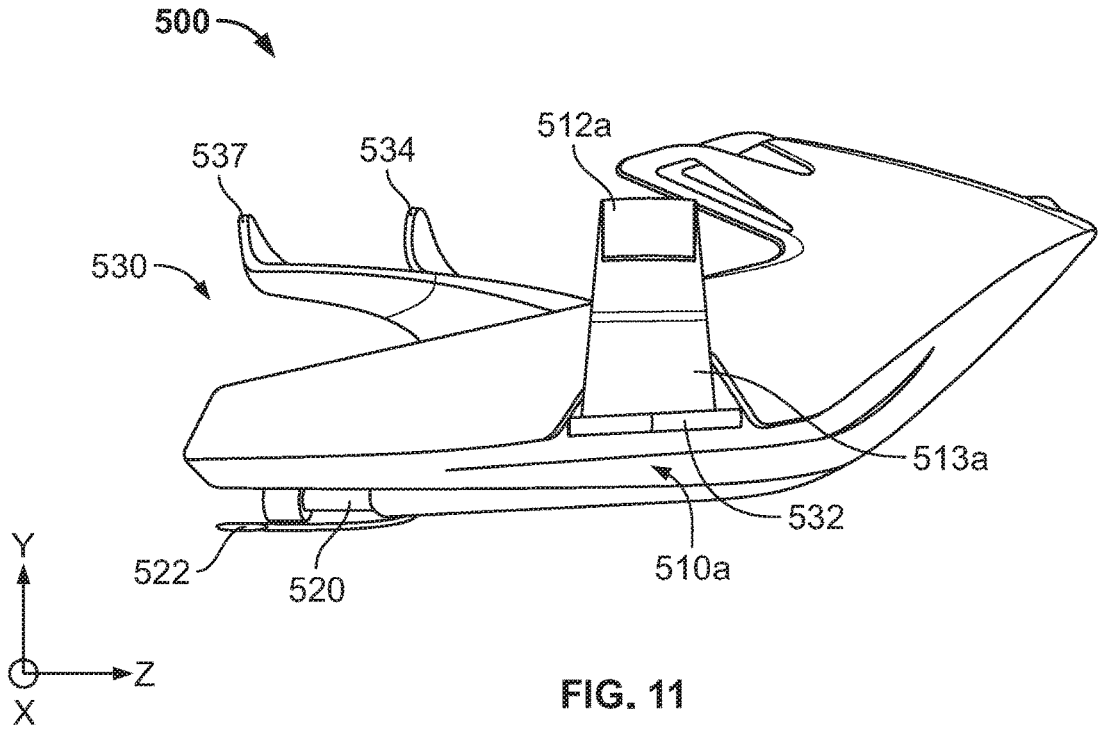
FIG. 11 depicts a side view of the watercraft of FIG. 9.

FIGS. 10-11 depict watercraft 500 that can include features of watercraft 100, except as discussed below. In this embodiment, watercraft 500 includes seats 534, 537 configured to support a first and second user. In alternative aspects, there may be three or more seats.

Continuing with this embodiment, FIG. 10 depicts watercraft 500 in foiling mode where front hydrofoils 510*a,b* are extended from body 530. Front hydrofoils 510*a,b* form a geometric structure through front transverse foil sections 511*a,b*, first front struts 512*a,b*, and second front struts 513*a,b*. Second front struts 513*a,b* transversely extend from opening 532 of body 530 away from the midline of body 530. First front struts 512*a,b* transversely extend from second struts 513*a,b* toward the midline of body 530 partially along the X-axis. Foil sections 511*a,b* transversely extend from first front struts 512*a,b* substantially along the X-axis. The bends between first front struts 512*a,b* and second front struts 513*a,b* may allow hydrofoils 510*a,b* to better absorb impact force during operation of watercraft 500. Further, the bent shape of these struts may also provide for improved adjustment of the struts by the computing device in that the angled shape distributes forces on the struts, allowing for easier movement of the struts, which may provide for the need for a smaller mechanism to move the strut, and thus, decreased weight of the watercraft.

Rear hydrofoil 520 includes rear transverse foil sections 522 extending from rear strut 521 (e.g., substantially along the Z-axis). In this manner, there is less drag and watercraft 500 can achieve greater speeds.

FIG. 11 depicts watercraft 500 in its hulling mode where front hydrofoils 510*a,b* is upwardly rotated about the Z-axis and opening 532 and rear hydrofoil 520 is retracted within body 530.

Further, the watercraft may be modular such that any of the hydrofoils can be easily removed and replaced with an alternate hydrofoil, such as a hydrofoil having a different shape. Such modularity additionally allows the hydrofoils to be placed at different locations along the body of the watercraft, and provides for easier repair and/or replacement of certain portions of the hydrofoil system. The internal structures of the watercraft, within the body, may also be modular. For instance, the body may include a modular battery pack system housed within the body. In this manner, the battery packs may be arranged to distribute the weight of the batteries as desired by the user or as set by the manufacturer. Further, such modularity may even allow the various hydrofoil elements of the present disclosure to be retrofitted onto an existing, previously non-foiling, watercraft.

FIGS. 12-14 depict one embodiment of an internal structure which would be positioned within the body (not shown) of a watercraft, such as watercraft 600. This internal structure can include features of watercraft 100. For instance, watercraft 600 includes front hydrofoils 610*a,b*, rear hydrofoil 620, chassis 660, and positioning system 650.

Front hydrofoils 610*a,b* includes a surface piercing hydrofoil with transverse foil section 610*a* running at an angle towards the waterline. As the length of front hydrofoils 610*a,b* that is in contact with the water changes, the amount of surface area of the front hydrofoils that is in contact with the water changes. Since the amount of lifting force correspondingly varies with the amount of surface area of front hydrofoils 610*a,b* in contact with the water, the surface piercing angle and structure of the hydrofoil allows for the hydrofoils to generate variable lifting forces relative to the height of watercraft 600 above the water; thus, providing for a degree of self-stabilization. For example, where watercraft 600 is in a foiling mode, as watercraft 600 and front hydrofoils 610*a,b* rises above the waterline, the surface area of the hydrofoils that is in contact with the water decreases, thus reducing the lifting force applied to the hydrofoils. Since watercraft 600 in foiling mode requires a certain amount of lifting force to be applied to front hydrofoils 610*a,b* to stay afloat, the decreased lifting force naturally brings the watercraft and hydrofoil down. As front hydrofoils 610*a,b* descends in the water, the surface area of the hydrofoil in contact with the water increases, thereby increasing the lifting force applied to the hydrofoil and watercraft 600. This constant variation between the amount of surface area of front hydrofoils 610*a,b* being in contact with the water can result in a degree of self-stability.

Chassis 660 includes a front support 661, rear support 662, and plate 663. Front support 661 is connected at a first end to plate 663, and at a second end to front positioning system 651*a* and front hydrofoil 610*a*. Rear support 662 is connected at a first end to plate 663, and at a second end to rudder system 656. Rudder system 656 is engaged with rear positioning system 651*c* and rear hydrofoil 620 such that actuation of the rudder system simultaneously rotates the rear positioning system and rear hydrofoil about the Y-axis. Two stacks of battery packs 670 are placed toward the center of plate 663.

Plate 663 has a number of bores extending along the Y-axis through the plate so that certain support structures (not shown) can be installed on the plate to secure certain internal components of watercraft 600, such as battery packs 670. In this manner, these internal components can be removed and placed at different locations along plate 663 to assist in distributing weight along the watercraft and for more efficient repairing. For instance, support structures can be installed that enables battery packs 670 to be rearranged such that each battery pack is not stacked on top of each other but can, instead, be positioned to lie along different portions of plate 663. For instance, battery packs 670 can be rearranged such that some battery packs are more towards the front of plate 663 and other battery packs may be placed more towards the rear of the plate. Moreover, in alternative aspects, there can be any number of battery packs 670, such as more or fewer than four. In a further alternative aspect, battery packs 670 can be directly installed on plate 663 without supporting structures being installed on the plate.

Positioning system 650 includes front positioning system 651*a,b*, rear positioning system 651*c*, hinging mechanisms 655*a,b*, and rudder system 656. In this manner, signals sent from a computing device, similar to computing device 140 depicted in FIG. 6, to positioning system 650 can individually adjust front hydrofoils 610*a,b* through front positioning systems 651*a,b* and hinging mechanisms 655*a,b* and rear hydrofoil 620 through rear positioning system 651*c* and rudder system 656. Front positioning systems 651*a,b* and rear positioning system 651*c* share the same features and respective engagements with front hydrofoils 610*a* and rear hydrofoils 620, except the front positioning system is located towards the front of watercraft 600 and connected to the front hydrofoil while the rear positioning system is located towards the rear of the watercraft and connected to the rear hydrofoil.

Continuing with this embodiment, FIG. 13 depicts first positioning system 651*a* having a first gear 653*a*, second gear 654*a*, and servo 652*a*. First gear 653*a* is engaged with servo 652*a* such that actuation of the servo can rotate the first gear. First gear 653*a* has a first set of ratchet teeth engaged with a second set of ratchet teeth of second gear 654*a* such that rotation of the first gear rotates the second gear. The ratchet teeth of second gear 654*a* is additionally engaged with the teeth along track 613*a* of front strut 611*a* such that rotation of the second gear translates front hydrofoil 610*a* along a first axis defined by the front strut. Front strut 611*a* is slidably received in sheath 664*a* to minimize movement of the front strut transverse to the first axis. In this manner, the computing device can send a signal to positioning system 650 to actuate servo 652*a*, rotate first gear 653*a* and second gear 654*a*, and translate hydrofoil 610*a* along the first axis.

Hinging mechanism 655*a* connects strut 611*a* and transverse foil section 612*a*. Hinging mechanism 655*a* is configured to allow for transverse foil section 612*a* to rotate about the X-, Y-, and/or Z-axes with respect to strut 611*a*. In this manner, the computing device can send a signal to positioning system 650 to actuate hinging mechanism 655*a* and adjust transverse foil section 612*a* with respect to strut 611*a*.

Figure 15:
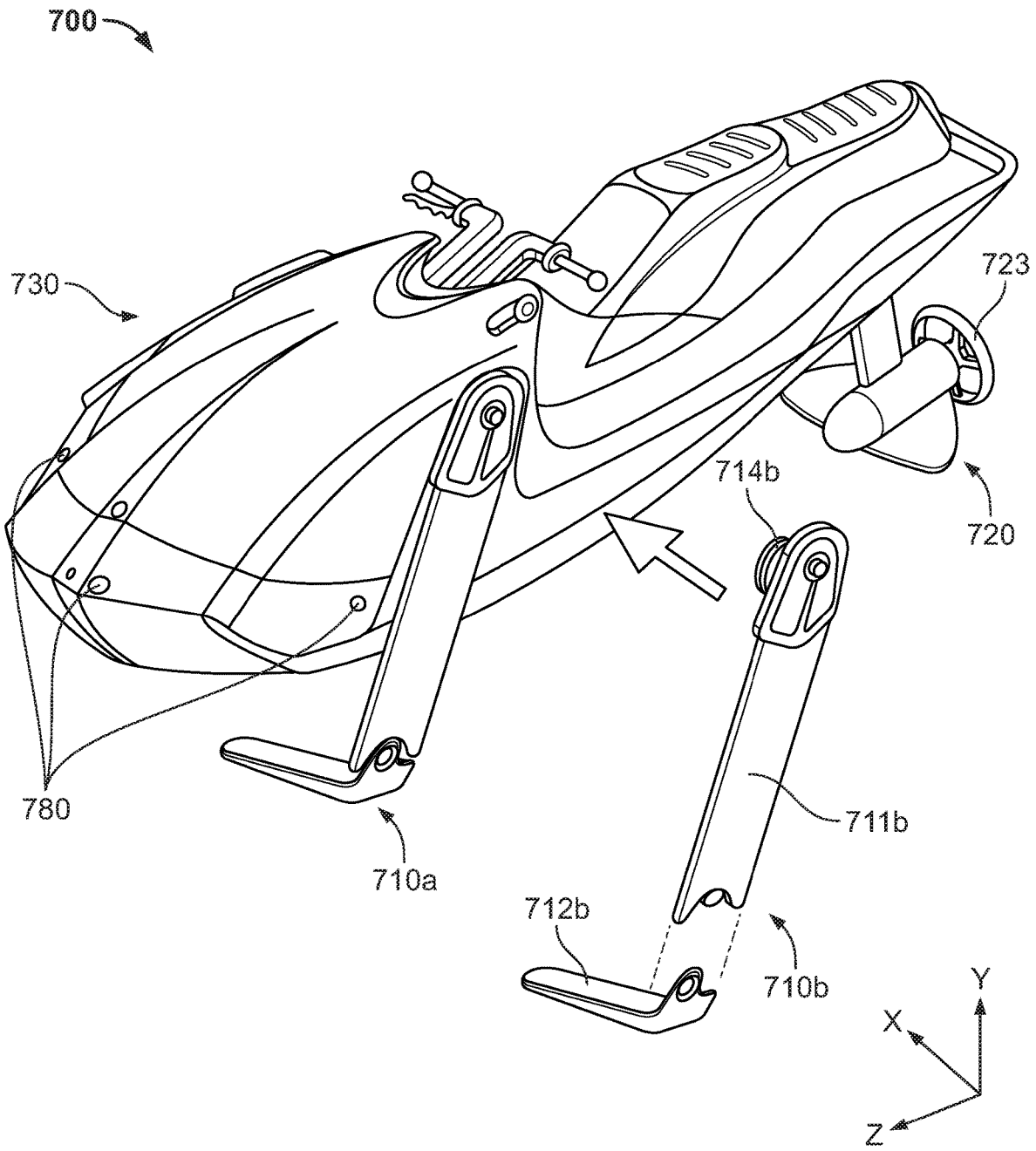
FIG. 15 depicts an isometric view of a watercraft according to yet another aspect of the disclosure.

In yet another embodiment, FIG. 15 depicts watercraft 700 that can include features of watercraft 100. In this embodiment, watercraft 700 depicts modular hydrofoils 710*a* and hydrofoil 710*b* having engagement mechanism 714*b*. For instance, hydrofoil 710*b* can be installed on body 730 by securing engagement mechanism 714*b* on body 730. In this manner, watercraft 730 can have two hydrofoils 710*a,b* along the same side of the body, as well as having rear hydrofoil 720. Additional hydrofoils can provide additional lifting forces to the watercraft. Alternatively, hydrofoil 710*b* can be installed along a portion of watercraft 700 closer to the center of body 730 and hydrofoil 710*a* can be removed. In further alternative aspects, there can be more or fewer than two hydrofoils 710*a,b* that can be placed along any portion of body 730. Such modularity allows for both custom placement of the hydrofoils as well as different types of hydrofoils to be interchanged. For example, hydrofoil 710*a* is a substantially L-shaped hydrofoil, however, due to the modularity of the hydrofoils of watercraft 700, hydrofoil 710*a* can be removed and replaced with an alternative hydrofoil (not shown) having a different geometric structure, such as a C-shape, J-shape or the like.

Sensors 780 are affixed to body 730 to provide data to the computing device (not shown) regarding the height of body 730 from the waterline when watercraft 700 is in foiling mode. Sensors 780 can be sonar, optical, proximity, or any other sensor capable of providing data to the computing device regarding the position of body 730 relative to the waterline. Sensors 780 are placed on watercraft 700 such that the sensors are aimed downward toward the waterline. Using the data collected from sensors 780, the computing device can adjust at least one of hydrofoils 710*a,b*, 720 and/or propulsion system 723 to maintain a certain height from the waterline. In this manner, watercraft 700 can have an "Autopilot" mode, where the computing system can use data from sensors 780 to maintain foiling mode and a certain distance above the water.

For example, where sensors 780 provide data that body 730 is less than 2 feet from the waterline, the computing system may send signals to the positioning system to adjust at least one of at least one of hydrofoils 710*a,b*, 720 by increasing the angle of attack of one or more of the hydrofoils in contact with the water and/or increase the speed of propulsion system 723. This can lift watercraft 700 until sensors 780 provide data to the computing device that the body is more than 2 feet from the waterline. Alternatively, the computing device can detect that body 730 is too high above the water line, through data provided by sensors 780, and adjust at least one of hydrofoils 710*a,b*, 720 and/or propulsion system 723 to decrease lift of watercraft 700.

Although FIG. 15 depicts watercraft 700 having sensors 780 located near the front of body 730, in alternative aspects, the sensors can be located along any portion of the body. For example, there can be three sensors 780 at the front as well as three sensors at the rear to provide data regarding the height of body 730 relative to the waterline all along the body.

Additionally, the individual portions of the hydrofoils can be modular and interchangeable. For instance, FIGS. 16-18 depict other examples of front hydrofoils for watercraft 800 that can include the features of watercraft 100, 200, 300, 400, 500, 600, 700 except as discussed below. Hydrofoil 810*a* can have strut 811*a* interchangeably engaged with any of transverse foil sections 812*a*, each of which has a different length. Hydrofoil 810*b* can have strut 811*b* interchangeably engaged with any of transverse foil sections 812*b*, each of which has a different level of curvature (similar to a J-foil). Hydrofoil 810*c* can have strut 811*c* interchangeably engaged with any of transverse foil sections 812*c*, each of which has a different length from both ends of the transverse foil section. In this manner, the level and variation of lifting force applied to any of the hydrofoils can be customized as desired through changing the type of transverse hydrofoil to engage with the strut. Each of transverse foil sections 812*a,b,c* can be interchanged with struts 811*a,b,c*, such that the transverse foil sections can be angled toward or away from watercraft 800, or any other angle with respect to the watercraft.

Figure 19:
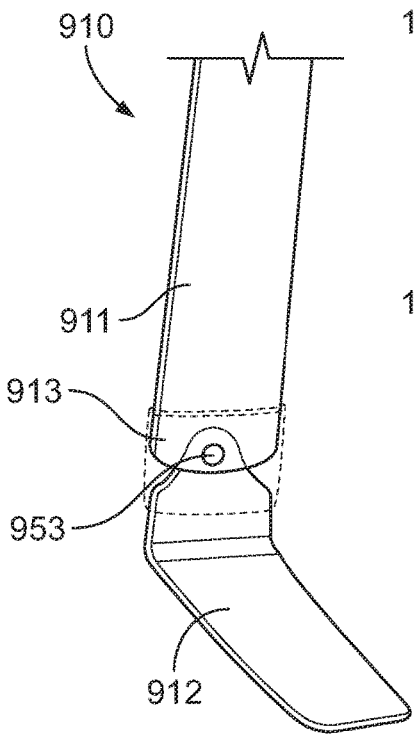
FIGS. 19-21 depict isolated views of various exemplary designs of a hydrofoil of a watercraft according to an aspect of the disclosure.
Figure 20:
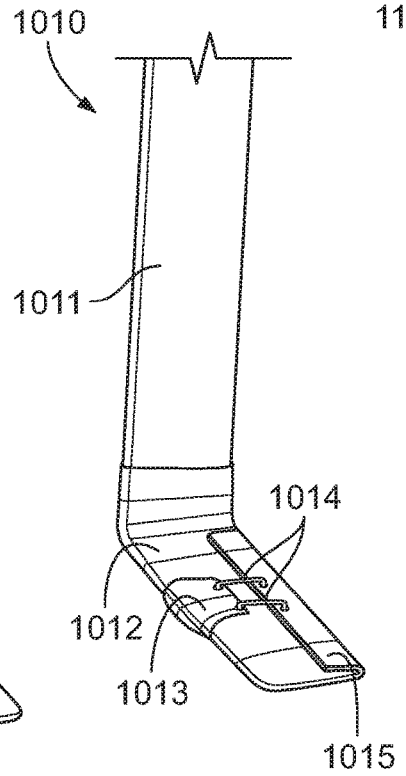
Figure 21:
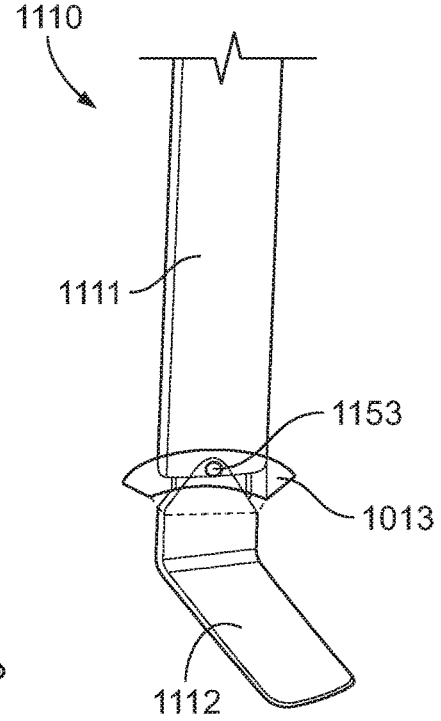

FIGS. 19-21 depict various hydrofoils 910, 1010, 1110 capable of having varying angles of attack and varying the lifting forces applied to the hydrofoils. For example, FIG. 19 depicts another embodiment of a hydrofoil 910 including a sleeve 913 surrounding hinging mechanism 953, and a portion of strut 911 and transverse foil section 912. Sleeve 913 is made of a malleable material, such as rubber. In this manner, sleeve 913 can offer support and protection to hinging mechanism 953 but can still allow for transverse foil section 912 to move with respect to strut 911.

FIG. 20 depicts another embodiment of a hydrofoil 1010. Transverse foil section 1012 includes servo 1013, tethers 1014, and flap 1015. Actuation of servo 1013 can apply a pulling force to tethers 1014 toward the servo to lift flap 1015 up. Additionally or alternatively, where tethers 1014 is made of a stiff material, actuation of servo 1013 can apply a pushing force to tethers 1014 away from servo 1013 to push flap 1015 down. In this manner, the lifting force applied to hydrofoil 1010 and watercraft 1000 can be manipulated by the movement of flap 1015. Such manipulation of the lifting forces can be in addition or in alternative to the movement of transverse foil sections 1012 relative to struts 1011, and/or movement of hydrofoil 1010 to the body of the watercraft. Servo 1013 is a part of the positioning system of watercraft 1000 such that a computing device, similar to computing device 140 shown in FIG. 6, can send a signal to servo 1013 to adjust flap 1015. In an alternative aspect, servo 1013 and tethers 1014 can be housed within the interior of transverse foil section 1012 rather than on the exterior of the transverse foil section.

FIG. 21 depicts another embodiment of a hydrofoil 1110. Hydrofoil 1110 is similar to hydrofoil 910 except sleeve 1013 has an upper flare to allow for smoother movement of transverse foil section 1112 relative to 1111 while still allow the sleeve to provide protection to hinging mechanism 1153.

Although the aspects described above disclose having only one rear hydrofoil, in alternative aspects, there can be more or less than one rear hydrofoil, such as no rear hydrofoil, with the propulsion system being housed within the body of the watercraft, or two or more rear hydrofoils. In a further alternative aspect, any of the hydrofoils can have multiple transverse foil sections stacked adjacent each other, such as being stacked on each other or side to side with each other.

One embodiment of the use of watercraft 100 will now be described with reference to FIGS. 1-6, however it is understood that a similar method may be applied to watercraft 200, 300, 400, 500, 600, 700, 800, 900, 1000, 1100. In such a use, a user may ride on a seat 134 and actuate propulsion system 123 by, for instance, engaging with steering system 135. Watercraft 100 is initially riding on hull 131 in its hulling mode either due to hydrofoils 110*a,b*, 120 being retracted or due to insufficient speed for hydrofoils 110*a,b*, 120 to provide a sufficient buoyance force to lift body 130 above the waterline. If hydrofoils 110*a,b*, 120 are retracted, the user may actuate a portion of watercraft 100, such as steering system 135, to extend hydrofoils 110*a,b*, 120 from body 130.

Figure 22:
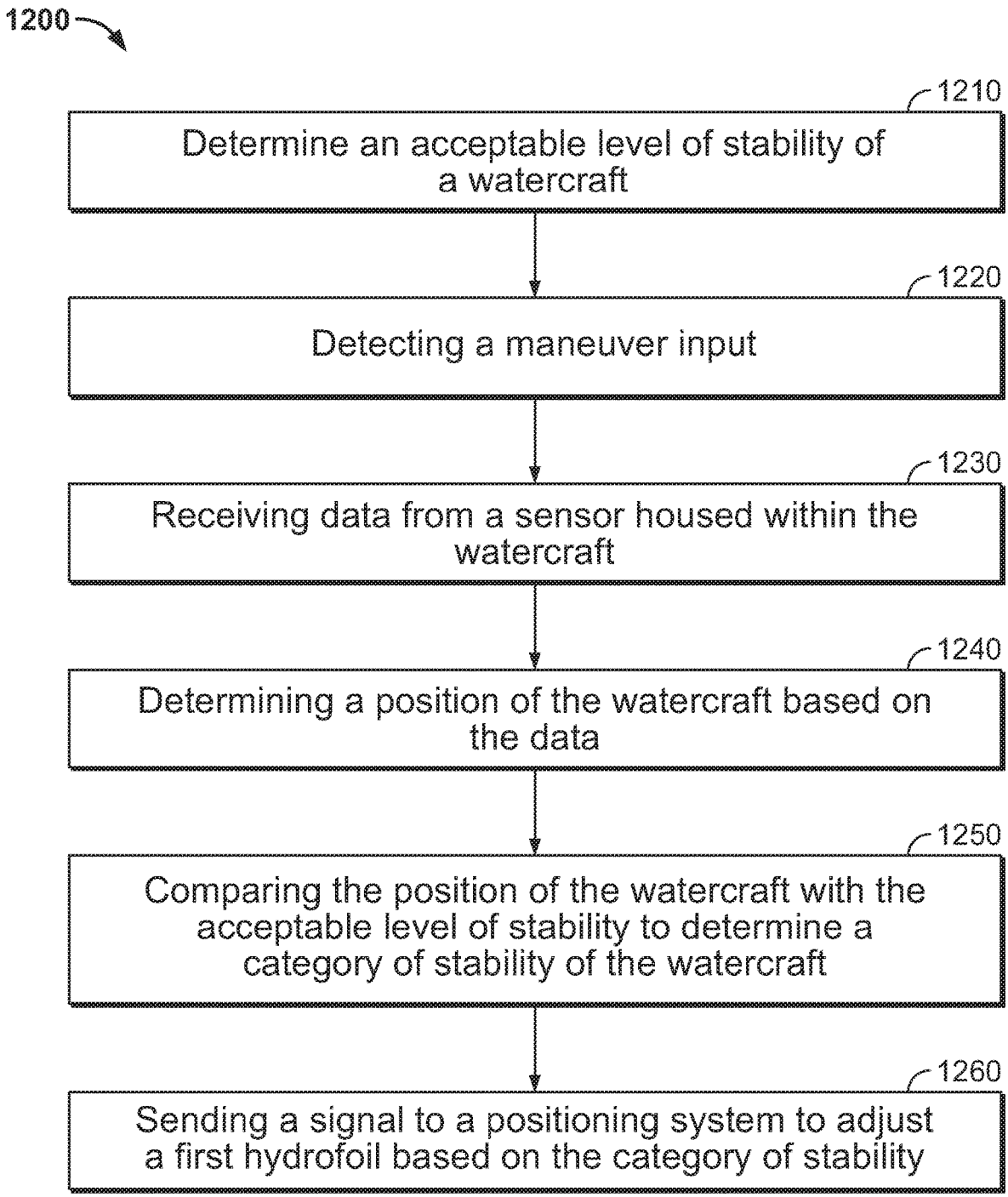
FIG. 22 depicts an example flowchart depicting a method in accordance with certain aspects of the disclosure.

After propulsion system 123 has been actuated and hydrofoils 110*a,b*, 120 are extended, watercraft 100 can increase in speed until the watercraft is lifted up by the hydrofoils and enters its foiling mode. Turning to FIG. 22, a flowchart 1200 is depicted for a method of operating a watercraft, such as watercraft 100, using computing device 140 while the watercraft is in its foiling mode.

Turning to step 1210, computing device 140 determines an acceptable level of stability. The acceptable level of stability can be determined from a user's selection of a Cruising or Sporty mode. Alternatively, the acceptable level of stability can be determined from a customized mode set by the user or determined by the computing device, including through the use of a machine learning algorithm, as described above. This acceptable level of stability can include multiple thresholds, such as a maximum acceptable pitch, roll and yaw tilt angle of watercraft 100, and/or a maximum acceptable distance that body 130 can be from the waterline. For example, the acceptable level of stability may have a maximum pitch angle of 10° and/or body 130 can have a maximum distance of 3 feet from the waterline.

Turning to step 1220, computing device 140 detects a maneuver input. The maneuver input may include the user shifting their weight to bank watercraft 100. Alternatively or additionally, the maneuver input can be from a user using steering system 135.

Watercraft 100 then performs the maneuver that corresponds to the maneuver input. For example, the user shifting their weight to the right can lead to watercraft 100 leaning right. Alternatively or additionally, with reference to FIG. 5, rotating steering system 135 about the Y-axis can lead to watercraft 100 turning in the direction of the steering system's rotation. For example, where steering system 135 is rotated to the right, at least a portion of right transverse foil section 112*a* can be downwardly rotated to decrease the angle of attack while at least a portion of left transverse foil section 112*b* can be upwardly rotated to increase the angle of attack. The decreased angle of attack of right transverse foil section 112*a* leads to a decreased amount of lifting force applied to right front hydrofoil 110*a* and the increased angle of attack of left transverse foil section 112*b* leads to an increased amount of lifting force applied to left front hydrofoil 110*b*. This difference in lifting forces leads to the watercraft 100 rolling clockwise substantially about the Z-axis and (optionally along with movement of the rudder and/or changing vertical angle of transverse foil sections 112*a,b* to generate yaw) making a right-turn maneuver.

Alternatively, the entire of hydrofoil 110*a* can be uniformly rotated downward toward the aft and the entire of hydrofoil 110*b* can be uniformly rotated upward toward the fore to achieve a similar effect. In a further alternative, transverse foil sections 112*a,b* and struts 111*a,b* can both be rotated to perform the turning maneuver. In a yet further alternative, hydrofoil 110*a* can additionally or alternatively be translated upward, and hydrofoil 110*b* can additionally or alternatively be translated downward to achieve a similar effect.

Turning to step 1230, computing device 140 receives data 144. Note that the sensors will have been collecting and storing data 144 in memory 142 from the time the user started operating watercraft 100, in addition to the computing device receiving data from the sensors following the maneuver input. Data 144 can include speed data of the watercraft, position data of hydrofoils 110*a,b*, 120 and body 130, force data of the hydrofoils, and the proximity data of the body to the waterline.

Turning to step 1240, one or more processors 141 of computing device 140 may execute instructions 143 to determine a position of watercraft 100 based on data 144. For example, computing device 140 can use data 144 to determine the distance of each side of watercraft 100 from the waterline and the position of each hydrofoil 110*a,b*, 120 to determine the current pitch, roll, and yaw angle of watercraft.

Turning to step 1250, computing device 140 can compare the position of watercraft 100 with the acceptable level of stability to determine a category of stability of the watercraft. For example, where computing device 140 has determined that watercraft 100 has a 10° roll angle and the acceptable level of stability has a maximum acceptable roll angle of 8°, the computing device will categorize the watercraft as unstable since the roll angle exceeds the maximum roll threshold of the acceptable level of stability. Alternatively, where computing device 140 has determined that watercraft 100 has a 10° roll angle and the acceptable level of stability has a maximum acceptable roll angle of 12°, the computing device will categorize the watercraft as stable as the roll angle does not exceed the maximum roll threshold of the acceptable level of stability.

Moreover, computing device 140 can determine that watercraft 100 can be unstable where only one threshold is exceeded. For example, computing device 100 can determine that watercraft 100 is unstable where a maximum acceptable roll angle threshold is exceeded even though the maximum acceptable distance from the waterline threshold is not exceeded.

Turning to step 1260, computing device 140 will send a signal to a positioning system to adjust a first hydrofoil based on the category of stability. For example, where computing device 140 determines that watercraft 100 is an unstable position, the computing device will send a signal to the positioning system to adjust at least one of hydrofoils 110*a,b*, 120 and/or propulsion system 123.

While the positioning system is adjusting at least one of hydrofoils 110*a,b*, 120 and/or propulsion system 123, the sensors continue to collect data 144 to send to computing device 140 for the computing device to determine the category of stability of watercraft 100. In this manner, computing device 140 will continue to send signals to the positioning system until the computing device detects that watercraft 100 is in a stable position. Once computing device 140 detects that watercraft 100 is in a stable position, the computing device will stop sending signals to the positioning system.

Figure 23:
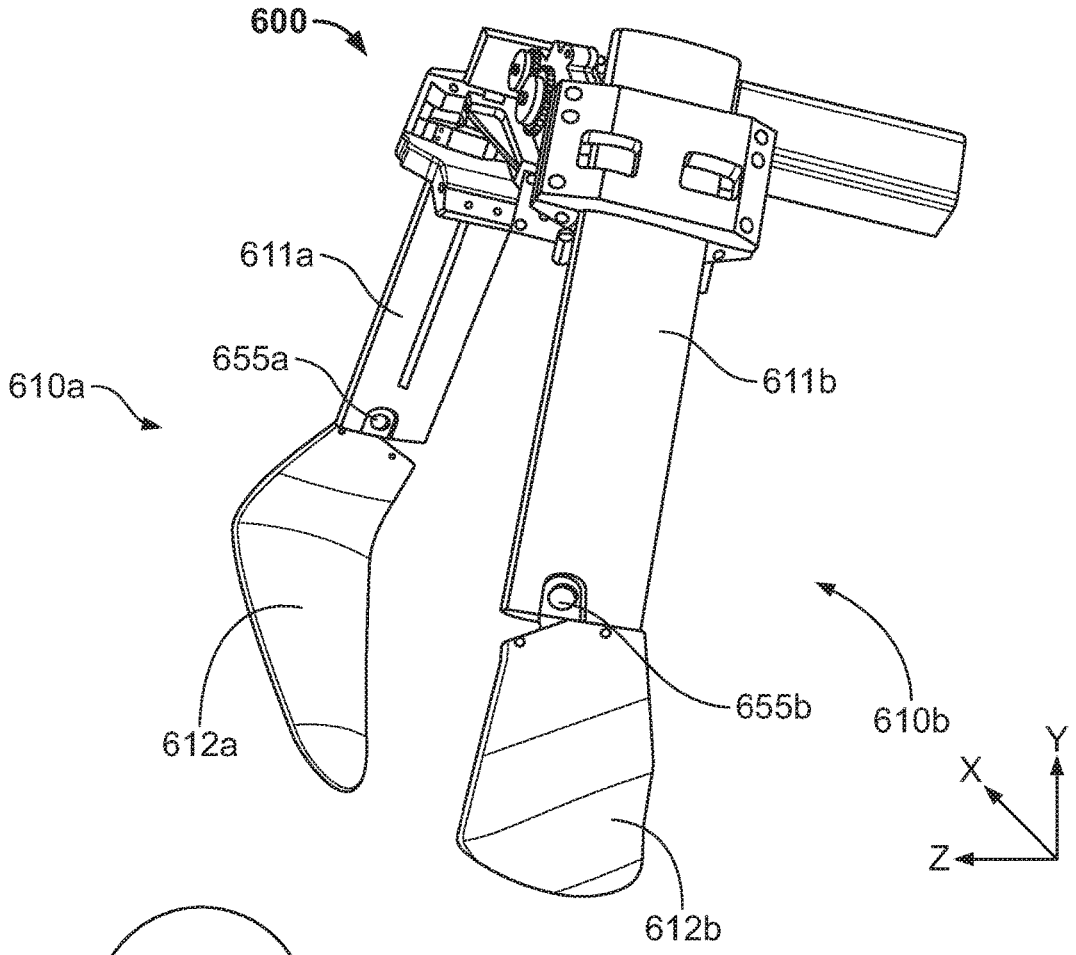
FIG. 23 depicts an exemplary method of use of the watercraft of FIG. 12.

In one example, with reference to watercraft 600 and FIGS. 12-14 and 23, watercraft 600 may be in a foiling mode and have an unstable position while banking right (e.g., having a clockwise roll angle that is higher than a maximum acceptable roll angle). In this instance, the computing device may send a signal to positioning system 650 to adjust at least one of hydrofoils 610*a,b*, 620, hinging mechanism 653, and/or propulsion system 623 to bring watercraft 600 into a more upright position. For instance, as shown in FIG. 23, positioning system 650 may send a signal to hinging mechanism 655*a* to upwardly rotate the tip of transverse foil section 612*a* substantially about the X-axis to increase the attack angle of hydrofoil 610*a*, thereby increasing the lifting force applied to front hydrofoil 610*a*. Additionally, positioning system 650 may send a signal to hinging mechanism 655*b* to downwardly rotate the tip of transverse foil section 612*b* substantially about the X-axis to decrease the attack angle of hydrofoil 610*b*, thereby decreasing the lifting force applied to front hydrofoil 610*b*. The resulting increase in lifting force applied to right hydrofoil 610*a* and decrease in lifting force applied to left hydrofoil 610*b* tilts watercraft 600 from an unstable position, tilted towards the right, to a more upright position.

Figure 24:
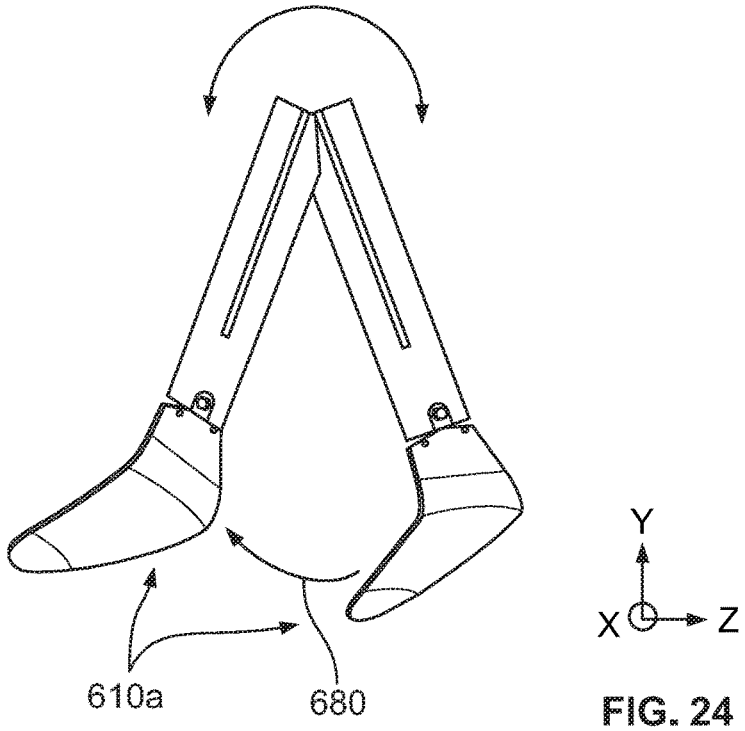
FIG. 24 depicts an isolated view of a hydrofoil of FIG. 12.

Alternatively or additionally, the computing device may send a signal to positioning system 650 to upwardly rotate the entirety of front hydrofoil 610*a* substantially about the X-axis and/or to downwardly rotate the entirety of front hydrofoil 610*b* substantially about the X-axis to similarly tilt watercraft 600 from an unstable position, tilted towards the right, to a more upright position. An example of this is shown in FIG. 24 where the entirety of hydrofoil 610*a* is rotated in direction 680 about the X-axis to increase the angle of attack and increase the lifting force applied to hydrofoil 610*a*. Although not shown, hydrofoil 610*b* can be rotated in a direction opposite direction 680 about the X-axis to decrease the angle of attack and decrease the lifting force applied to hydrofoil 610*b*. In this manner, watercraft 100 may be rotated in a counter-clockwise direction, from a direction unstably tilted to the right, to a more upright position.

Further, the computing device may alternatively or additionally send a signal to positioning system 650 to translate at least one of front hydrofoils 610*a,b*. For instance, with reference to FIG. 13, the computing device may send a signal to positioning system 651 to actuate servo 652*a* to rotate first gear 653*a* in a clockwise direction (from the viewpoint of the user). Clockwise rotation of first gear 653*a* rotates second gear 654*a* in a counter-clockwise direction through the engagement between the teeth of the first and second gears. Counter-clockwise rotation of second gear 654*a* axially translates front hydrofoil 610*a* upwards through the engagement between the teeth of the second gear and track 613*a*. In this manner, the surface area of front hydrofoil 610*a* in contact with the water decreases as front hydrofoil 610*a* axially translates upward, thereby decreasing the lifting force applied to front hydrofoil 610*a* and tilting watercraft 600 from an unstable position tilted towards the left to a more upright position.

The computing device of watercraft 600 may continue sending signals to positioning system 650 to make adjustments until the computing device detects, from data collected from the sensors, that the watercraft is in a stable position.

Turning back to watercraft 100 and FIGS. 1-6, once the user has decided to stop operating watercraft 100, the user may slow down watercraft 100 until the watercraft is riding on hull 131 and is in hulling mode again. In this instance, the positioning system may retract hydrofoils 110*a,b*, 120 within body 130. Alternatively, hydrofoils 110*a,b*, 120 may be retracted while watercraft 100 is still at speed. In this instance, watercraft 100 will enter its hulling mode once hydrofoils 110*a,b*, 120 have been full retracted.

Although the invention herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A personal watercraft comprising:

a body having a seat and a hull, the seat configured to support a user with the body floating in water;

a plurality of hydrofoils extending outwards from the body and coupled to a positioning system, the plurality of hydrofoils being configured, in combination, to raise the hull of the personal watercraft above a waterline in the water when the personal watercraft is in use and under the influence of a propulsion force, the plurality of hydrofoils including two front hydrofoils disposed on opposing sides of a centerline of the hull, each of the two front hydrofoils being J-shaped;

a rear hydrofoil of the plurality of hydrofoils extending from a central portion of the hull, the rear hydrofoil being retractable and extendable relative to the hull;

one or more sensors that provide sensor data of the watercraft during use;

a computer-readable medium having a processor and a memory having instructions that, when executed by the processor:

read the sensor data; and based on the read sensor data, send a signal to the positioning system to adjust the position for at least one of the plurality of hydrofoils.

2. The personal watercraft of claim 1, wherein each of the hydrofoils has a strut extending vertically outward away from the body of the personal watercraft and a transverse foil section extending transverse to the strut.

3. The personal watercraft of claim 2, wherein the transverse section of each hydrofoil extends transverse to the strut.

4. The personal watercraft of claim 3, wherein the sensor data includes any of speed data, force data, position data, or proximity data.

5. The personal watercraft of claim 1, wherein the sensor data includes a first data and a second data, wherein the instructions are based on the first data for a first of the plurality of hydrofoils of the plurality of hydrofoils and a second data for a second of the plurality of hydrofoils of the plurality of hydrofoils, the first data being different than the second data, wherein the first data is a first proximity data or force data and the second data is a second proximity data or force data.

6. The personal watercraft of claim 5, wherein a y-axis extends vertically through the body, an x-axis extends horizontally through the body, and a z-axis extends lengthwise through the body, and the sensor data comprises data that positions each of the plurality of hydrofoils at a different position along at least one of the y-axis, the x-axis, and the z-axis.

7. The personal watercraft of claim 6, wherein the sensor data comprises data that positions each of the plurality of hydrofoils at a different position along each of the y-axis, the x-axis, and the z-axis.

8. The personal watercraft of claim 6, wherein the instructions include first and second instructions that correspond to first and second different riding modes for the personal watercraft, the first instructions, when executed, sends a first signal to the positioning system to adjust the position for each of the plurality of hydrofoils based on a first positioning data for each of the plurality of hydrofoils, and the second instructions, when executed, sends a second signal to the positioning system to adjust the position for each of the plurality of hydrofoils based on a second positioning data for each of the plurality of hydrofoils, the first and second positioning data for the first and second riding modes resulting in a different riding experience for the personal watercraft.

9. The personal watercraft of claim 1, wherein the rear hydrofoil of the plurality of hydrofoils extends outwards from a rear of the body, the rear hydrofoil including a propulsion system and being movable along a y-axis extending vertically through the body.

10. The personal watercraft of claim 1, further comprising a propulsion system for providing the propulsion force.

11. The personal watercraft of claim 10, wherein the one or more sensors include a first proximity or force sensor, the first proximity or force sensor configured to provide a portion of the sensor data to the computer-readable medium.

12. A personal watercraft comprising:

a body having a seat and a hull, the seat configured to support a user with the body floating in water;

a plurality of hydrofoils extending outwards from the body and operably coupled to a positioning system including:

a rear hydrofoil extending from a centerline of the hull;

two front hydrofoils extending from the hull disposed on opposing sides of a centerline of the hull, each of the two front hydrofoils being J-shaped, wherein at least one of the rear hydrofoil and the two front hydrofoils includes an adjustable surface;

one or more sensors that provide sensor data of the watercraft during use; and a processor configured to read the sensor data and adjust the position for at least one of the plurality of hydrofoils.

13. The watercraft of claim 12, wherein each of the plurality of hydrofoils includes a strut and a transverse foil section.

14. The watercraft of claim 12, wherein the processor is configured to read the sensor data and communicate with a servo to rotate the adjustable surface to modify a course of the watercraft.

15. The watercraft of claim 12, wherein at least one of the plurality of hydrofoils is independently retractable and extendable from the hull.

16. The watercraft of claim 12, wherein the processor independently adjusts each of the plurality of hydrofoils along the y-axis based on a reading of at least one of the position data and the sensor data.

17. The watercraft of claim 12, wherein the rear hydrofoil includes the adjustable surface.

18. The watercraft of claim 17, wherein the adjustable surface includes two adjustable surfaces, each adjustable surface disposed on opposite sides of a strut on a trailing surface of the rear hydrofoil.

19. The watercraft of claim 18, wherein each adjustable surface is configured to control the pitch and roll of the watercraft.

* * * * *